US011106169B2

(12) United States Patent
Mochizuki et al.

(10) Patent No.: US 11,106,169 B2
(45) Date of Patent: Aug. 31, 2021

(54) DETERMINING LIFETIME OF A DEVELOPING APPARATUS IN AN IMAGE FORMING APPARATUS

(71) Applicant: CANON KABUSHIKI KAISHA, Tokyo (JP)

(72) Inventors: Masataka Mochizuki, Mishima (JP); Katsuichi Abe, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/733,354

(22) Filed: Jan. 3, 2020

(65) Prior Publication Data

US 2020/0218173 A1 Jul. 9, 2020

(30) Foreign Application Priority Data

Jan. 8, 2019 (JP) ..... JP2019-001415
Nov. 26, 2019 (JP) ..... JP2019-213343

(51) Int. Cl.
*G03G 15/00* (2006.01)
*G03G 15/08* (2006.01)

(52) U.S. Cl.
CPC ..... *G03G 15/553* (2013.01); *G03G 15/556* (2013.01); *G03G 15/0856* (2013.01); *G03G 2221/1823* (2013.01)

(58) Field of Classification Search
CPC ..... G03G 15/553; G03G 15/556; G03G 2221/1663
USPC ..... 399/27
See application file for complete search history.

(56) References Cited

U.S. PATENT DOCUMENTS 7,319,826 B2 * 1/2008 Shim ..... G03G 15/5062 399/12
8,565,625 B2 10/2013 Nishimura
10,719,029 B2 * 7/2020 Hirata ..... G03G 15/081
2009/0232556 A1 * 9/2009 Fukuyama ..... G03G 15/0844 399/236

(Continued)

FOREIGN PATENT DOCUMENTS

JP 2009222892 A * 10/2009
JP 2010002666 A * 1/2010

(Continued)

*Primary Examiner* — Robert B Beatty
(74) *Attorney, Agent, or Firm* — Rossi, Kimms & McDowell LLP

(57) ABSTRACT

An image forming apparatus having a first mode and a second mode with respectively different rotational peripheral velocity ratios of a developer bearing member, stores a first lifetime threshold value of a developing apparatus corresponding to the first mode and a second lifetime threshold value of the developing apparatus corresponding to the second mode, updates a lifetime determination value of a developing apparatus on the basis of drive amount information when the developer bearing member operates in the first mode and second modes, performs a first determination related to a lifetime in the first mode on the basis of the first lifetime threshold value and the lifetime determination value, performs a second determination related to a lifetime in the second mode on the basis of the second lifetime threshold value and the lifetime determination value, and makes a notification on the basis of determination results.

14 Claims, 17 Drawing Sheets

(56) References Cited

U.S. PATENT DOCUMENTS

2014/0072314 A1* 3/2014 Miyahara ..... G03G 15/556
399/27

FOREIGN PATENT DOCUMENTS

| | | | | |
|---|---|---|---|---|
| JP | 4743273 | B2 | | 8/2011 |
| JP | 2016161645 | A | * | 9/2016 |
| JP | 2016161645 | A | | 9/2016 |
| JP | 2020106744 | A | * | 7/2020 |

* cited by examiner

FIG.13

OCCURRENCE STATUS OF IMAGE DENSITY NON-UNIFORMITY DUE TO BANDING IN HIGH-DENSITY MODE

| | | REMAINING LIFETIME OF DEVELOPING CARTRIDGE | | |
|---|---|---|---|---|
| | | 100% to 60% | 59% to 30% | 29% to 0% |
| REMAINING LIFETIME OF DRUM CARTRIDGE | 100% to 60% | GOOD | ORDINARY | NO GOOD |
| | 59% to 30% | GOOD | GOOD OR ORDINARY | ORDINARY OR NO GOOD |
| | 29% to 0% | GOOD | GOOD | ORDINARY |

DETERMINING LIFETIME OF A DEVELOPING APPARATUS IN AN IMAGE FORMING APPARATUS

BACKGROUND OF THE INVENTION

Field of the Invention

The present invention relates to a technique for determining a lifetime of a developing apparatus provided in an image forming apparatus such as a copier, a printer, a facsimile machine, or the like which uses an electrophotographic system, an electrostatic recording system, or the like.

Description of the Related Art

In an image forming apparatus such as a printer using an electrophotographic image formation system (an electrophotographic process), an electrophotographic photosensitive member (hereinafter, referred to as a "photosensitive member") as an image bearing member is uniformly charged and the charged photosensitive member is selectively exposed to form an electrostatic image on the photosensitive member. The electrostatic image formed on the photosensitive member is developed as a toner image with toner as a developer. Subsequently, image recording is performed by transferring the toner image formed on the photosensitive member to a recording material such as a sheet of recording paper or a plastic sheet and further applying heat and pressure to the toner image having been transferred onto the recording material to fix the toner image to the recording material.

Such an image forming apparatus generally requires replenishment of a developer and maintenance of various process means. In order to facilitate such a replenishment operation of the developer and maintenance of various process means, process cartridges are being put to practical use which are made by collectively configuring a photosensitive member, a charging unit, a developing unit, a cleaning unit, and the like inside a frame body and which are attachable to and detachable from an image forming apparatus main body. According to the process cartridge system, an image forming apparatus with superior usability can be provided.

With such a process cartridge, as the number of times image formation is performed increases, toner is generated which is repetitively recovered without being developed on a photosensitive drum that is an example of a photosensitive member. Such toner may incur deterioration due to repetitive formation of toner images causing an added external additive to be released from or embedded in resin particles constituting a base of the toner. In such a case, due to the toner's inability to obtain a desired amount of charge, so-called fogging where the toner adheres to a white part of an image or the like may occur. In consideration thereof, Japanese Patent No. 4743273 proposes calculating degrees of deterioration of toner in an image forming apparatus and determining that a developing apparatus has come to the end of its lifetime by integrating the degrees of deterioration. In addition, Japanese Patent Application Laid-open No. 2016-161645 proposes determining a more optimal developing apparatus lifetime by also taking into consideration a degree of deterioration of a developing roller in accordance with a degree of so-called filming where toner or an external additive accumulates on the developing roller.

In recent years, one of the wide variety of market needs is to increase image density and expand a tint to enable images with enhanced colorfulness to be obtained. To this end, the following technique is known. There is a technique which includes, in addition to a mode for obtaining general image density, a mode for changing a peripheral velocity ratio between a photosensitive drum and a developing roller as means to realize high image density and an increase in a tint, and which increases a toner supply amount to the photosensitive drum to increase a toner amount on a recording medium.

Studies carried out by the present inventors revealed that using this technique to perform printing by increasing the peripheral velocity ratio between a photosensitive drum and a developing roller affects deterioration of the developing roller. When the developing roller deteriorates prematurely, a volume resistance value increases, and since a charge of toner on the developing roller is less likely to be discharged to the developing roller, the toner starts to store charges. Accordingly, for example, the charge held by the toner on the developing roller becomes excessive and control by a control member becomes insufficient. For this reason, a so-called control failure may occur at an early timing, and an increase in a toner amount on the developing roller caused by the control failure may result in an occurrence of banding due to slippage of the developing roller and the photosensitive drum. In other words, a user is desirably informed of a lifetime of a developing apparatus at an appropriate timing.

SUMMARY OF THE INVENTION

In order to achieve the object described above, an image forming apparatus of the present invention includes:

a rotatable image bearing member; and a developing apparatus including a developer bearing member which supplies a developer to the image bearing member and which develops an electrostatic latent image on the image bearing member, the image forming apparatus having a first mode in which the developer bearing member rotates at a first peripheral velocity ratio with respect to the image bearing member and a second mode in which the developer bearing member rotates at a second peripheral velocity ratio that is larger than the first peripheral velocity ratio with respect to the image bearing member, wherein the image forming apparatus includes:

a storage unit which stores a first lifetime threshold value of the developing apparatus corresponding to the first mode and a second lifetime threshold value of the developing apparatus corresponding to the second mode;

a controller which, on the basis of first drive amount information when the developer bearing member operates in the first mode and second drive amount information when the developer bearing member operates in the second mode, progressively adds drive amount information of the developer bearing member with respect to a lifetime determination value of the developing apparatus or progressively subtracts the drive amount information of the developer bearing member from an initial value to update the lifetime determination value; and a notifying unit, wherein, the controller performs:

a first determination related to a lifetime in the first mode on the basis of (i) the first lifetime threshold value and the lifetime determination value or (ii) the lifetime determination value and a third lifetime threshold value calculated using one of the second lifetime threshold value and a reference lifetime threshold value; and a second determination related to a lifetime in the second mode on the basis of (i) the second lifetime threshold value and the lifetime determination value or (ii) the lifetime determination value and a fourth lifetime threshold value calculated using one of the first lifetime threshold value and the reference lifetime threshold value, and the notifying unit performs a notification on the basis of a determination result by the controller.

In order to achieve the object described above, an image forming apparatus of the present invention includes:

a rotatable image bearing member; and a developing apparatus including a developer bearing member which supplies a developer to the image bearing member and which develops an electrostatic latent image on the image bearing member, the image forming apparatus having a first mode in which the developer bearing member rotates at a first peripheral velocity ratio with respect to the image bearing member and a second mode in which the developer bearing member rotates at a second peripheral velocity ratio that is larger than the first peripheral velocity ratio with respect to the image bearing member, wherein the image forming apparatus includes:

a storage unit which stores any one of a first lifetime threshold value of the developing apparatus corresponding to the first mode, a second lifetime threshold value of the developing apparatus corresponding to the second mode, and a reference lifetime threshold value;

a controller which calculates a lifetime determination value on the basis of first drive amount information when the developer bearing member operates in the first mode and second drive amount information when the developer bearing member operates in the second mode; and a notifying unit, wherein, the controller performs:

a first determination related to a lifetime in the first mode on the basis of (i) the first lifetime threshold value and the lifetime determination value or (ii) the lifetime determination value and a third lifetime threshold value calculated using one of the second lifetime threshold value and the reference lifetime threshold value; and a second determination related to a lifetime in the second mode on the basis of (i) the second lifetime threshold value and the lifetime determination value or (ii) the lifetime determination value and a fourth lifetime threshold value calculated using one of the first lifetime threshold value and the reference lifetime threshold value, and the notifying unit performs a notification on the basis of a determination result by the controller.

In order to achieve the object described above, an image forming apparatus of the present invention includes:

a rotatable image bearing member; and a developing apparatus including a developer bearing member which supplies a developer to the image bearing member and which develops an electrostatic latent image on the image bearing member, the image forming apparatus having a first mode in which the developer bearing member rotates at a first peripheral velocity ratio with respect to the image bearing member and a second mode in which the developer bearing member rotates at a second peripheral velocity ratio that is larger than the first peripheral velocity ratio with respect to the image bearing member, wherein the image forming apparatus includes:

a storage unit which stores a lifetime threshold value of the developing apparatus;

a controller which calculates a first lifetime determination value corresponding to the first mode and a second lifetime determination value corresponding to the second mode on the basis of first drive amount information when the developer bearing member operates in the first mode and second drive amount information when the developer bearing member operates in the second mode; and a notifying unit, wherein, the controller causes:

the notifying unit to perform a first notification related to a lifetime of the developing apparatus in the first mode on the basis of a comparison between the lifetime threshold value and the first lifetime determination value; and the notifying unit to perform a second notification related to the lifetime of the developing apparatus in the second mode on the basis of a comparison between the lifetime threshold value and the second lifetime determination value.

Further features of the present invention will become apparent from the following description of exemplary embodiments (with reference to the attached drawings).

BRIEF DESCRIPTION OF THE DRAWINGS

FIG. 13 is a diagram showing an occurrence status of banding in a high-density mode.

DESCRIPTION OF THE EMBODIMENTS

Hereinafter, exemplary embodiments for carrying out the present invention will be described in detail with reference to the drawings. Dimensions, materials, shapes, and relative arrangements of the components described in the embodiments may be changed appropriately depending on a configuration of an apparatus to which the present invention is applied and various conditions. That is, the scope of the present invention is not limited to the following embodiments.

First Embodiment

Figure 1:
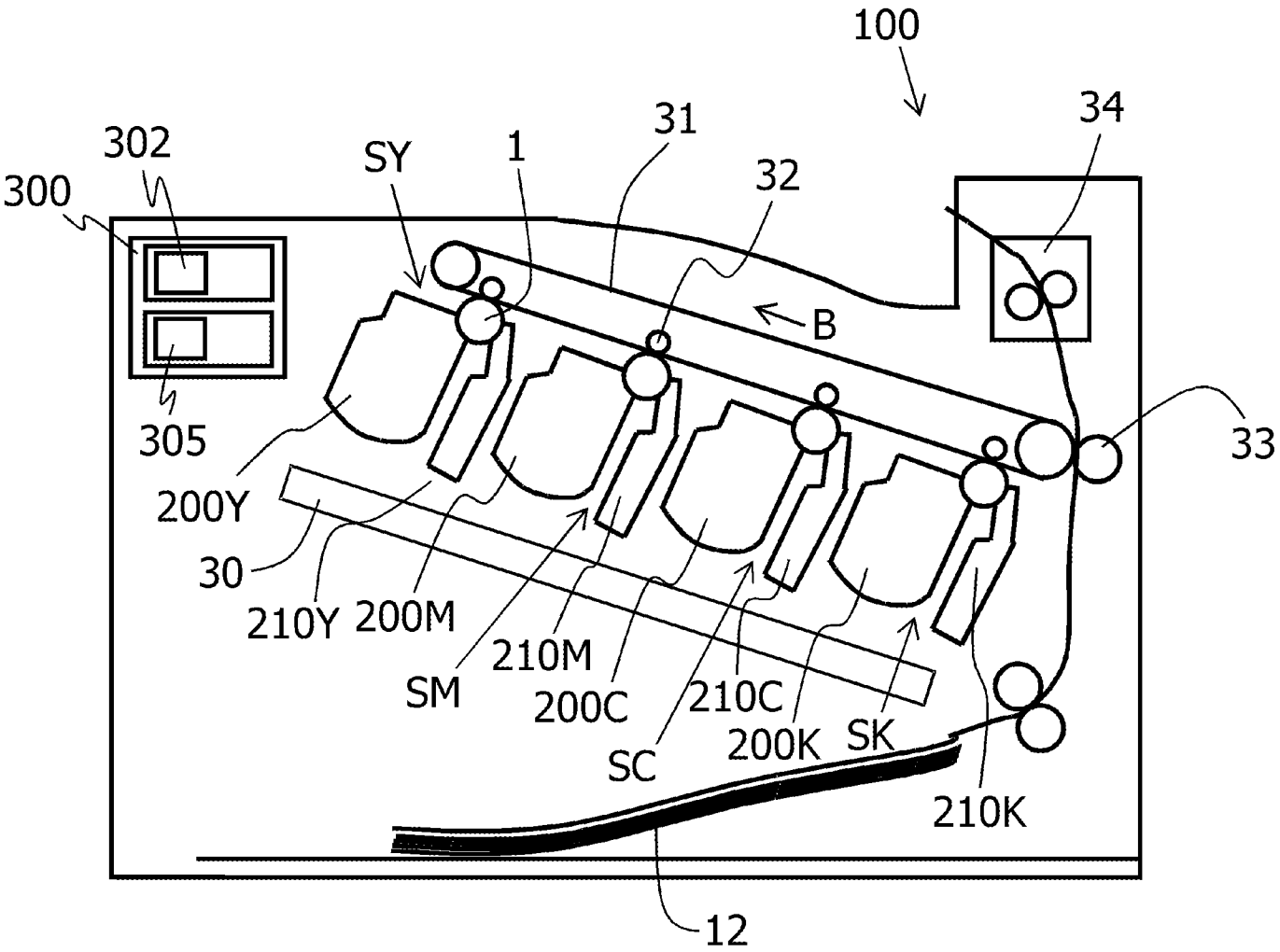
FIG. 1 is a schematic view of an image forming apparatus.

An overall configuration of an embodiment of an electrophotographic image forming apparatus (an image forming apparatus) will be described. FIG. 1 is a sectional view of an image forming apparatus 100 according to the present embodiment. The image forming apparatus 100 according to the present embodiment is a full-color laser beam printer adopting an in-line system and an intermediate transfer system. The image forming apparatus 100 is capable of forming a full-color image on recording material (for example, recording paper, a plastic sheet, and cloth) in accordance with image information. The image information is input to an image forming apparatus main body from an image reading apparatus connected to the image forming apparatus main body or from a host device such as a personal computer connected to the image forming apparatus main body so as to be capable of communication. The image forming apparatus 100 has SY, SM, SC, and SK as a plurality of image forming portions for respectively forming images of each of the colors of yellow (Y), magenta (M), cyan (C), and black (K). In the present embodiment, the image forming portions SY, SM, SC, and SK are arranged in a single row in a direction intersecting a vertical direction.

Figure 2:
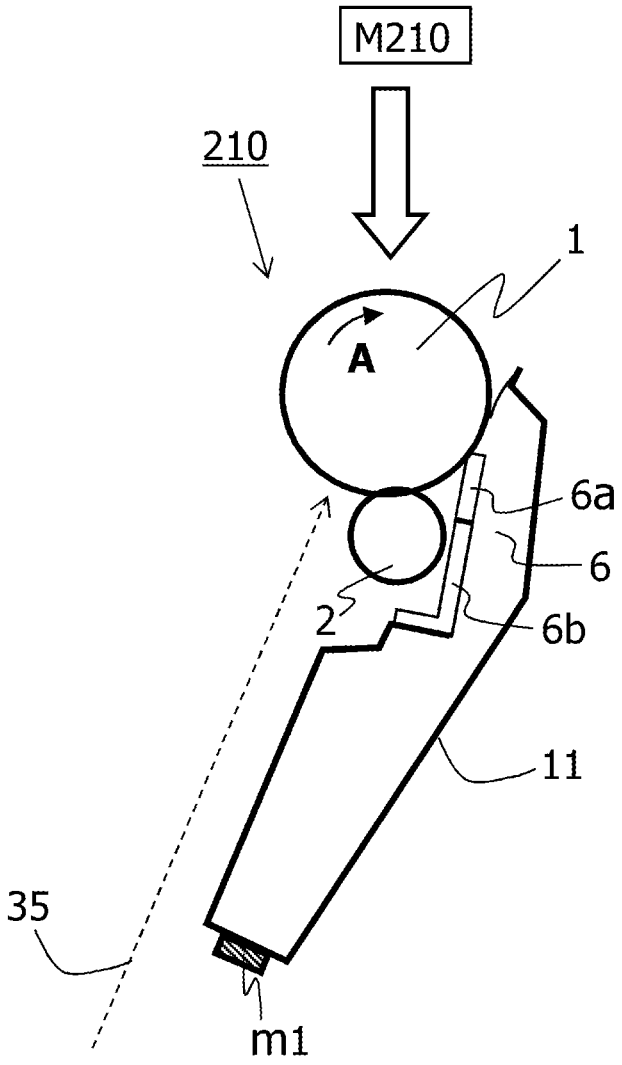
FIG. 2 is a schematic view of a drum cartridge.
Figure 3:
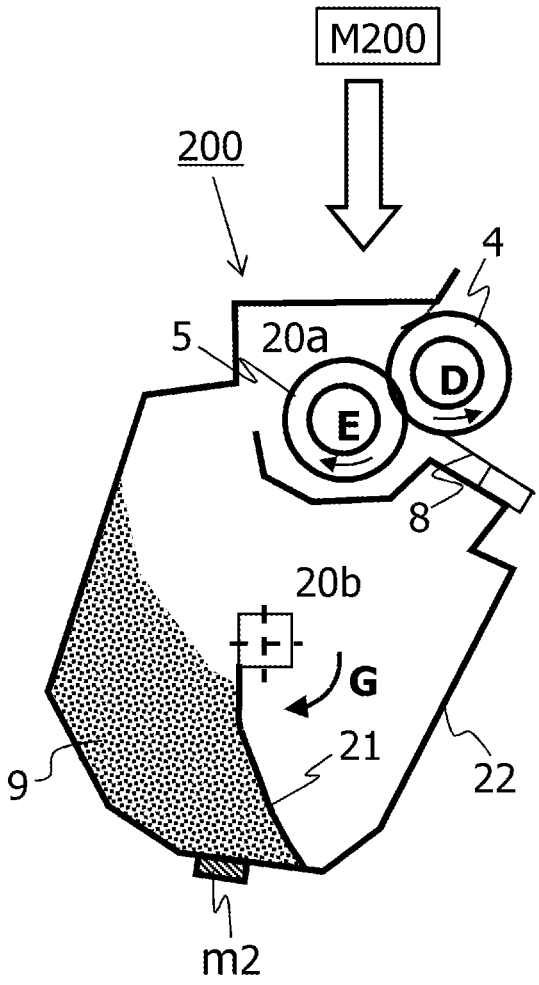
FIG. 3 is a schematic view of a developing cartridge.

Although a detailed description will be given later, in the image forming apparatus 100 according to the present embodiment, a photosensitive drum 1, a charging roller 2, a cleaning blade 6, and a drum cartridge frame body 11 shown in FIG. 2 are integrally constructed as a drum cartridge 210 for the purposes of simplifying maintenance and the like. In addition, a developing roller 4, a toner supplying roller 5, a toner amount control member 8, and a developer container 22 constituting a developing chamber 20*a* and a developer storage chamber 20*b* shown in FIG. 3 are integrally constructed in a similar manner as a developing cartridge 200 as a developing apparatus.

The image forming portions described earlier are constituted by drum cartridges 210 (210Y, 210M, 210C, and 210K) and developing cartridges 200 (200Y, 200M, 200C, and 200K). The drum cartridges 210 and the developing cartridges 200 are configured to be attachable to and detachable from the image forming apparatus 100 via mounting means such as a mounting guide, a positioning member, or the like that is provided on an image forming apparatus main body. In the present embodiment, all of the drum cartridges 210 and the developing cartridges 200 for the respective colors have a same shape, and toners of the respective colors of yellow (Y), magenta (M), cyan (C), and black (K) are stored in the developing cartridges 200 for the respective colors. While a configuration in which the drum cartridge 210 and the developing cartridge 200 are independently attachable and detachable will be described in the present embodiment, alternatively, a configuration may be adopted in which the drum cartridge 210 and the developing cartridge 200 are integrated and are attachable to and detachable from the image forming apparatus main body as a single component.

The photosensitive drum 1 is rotationally driven by driving means (a drive source) (not illustrated). A scanner unit (an exposing apparatus) 30 is arranged around the photosensitive drum 1. The scanner unit 30 is an exposing unit which irradiates a laser beam based on image information and forms an electrostatic image (an electrostatic latent image) on the photosensitive drum 1. Writing of laser exposure is performed in a main scanning direction (a direction perpendicular to a transport direction of a recording material 12) from a position signal inside a polygon scanner referred to as a BD for each scanning line. Meanwhile, in a sub-scanning direction (the transport direction of the recording material 12), writing of laser exposure is performed after a delay of a prescribed time from a TOP signal originating from a switch (not illustrated) inside a transport path of the recording material 12. Accordingly, in four process stations Y, M, C, and K, laser exposure can always be performed with respect to a same position on the photosensitive drum 1.

An intermediate transfer belt 31 as an intermediate transfer member for transferring a toner image on the photosensitive drum 1 to the recording material 12 is arranged so as to oppose the four photosensitive drums 1. The intermediate transfer belt 31 as an intermediate transfer member formed by an endless belt is in contact with all of the photosensitive drums 1 and circulatively moves (rotates) in a direction of an illustrated arrow B (counterclockwise). Four primary transfer rollers 32 as primary transfer units are arranged parallel to each other on a side of an inner peripheral surface of the intermediate transfer belt 31 so as to oppose each photosensitive drum 1. In addition, a bias having an opposite polarity to a normal charging polarity of the toner is applied to the primary transfer roller 32 from a primary transfer bias power supply (a high-voltage power supply) as a primary transfer bias applying unit (not illustrated). Accordingly, a toner image on the photosensitive drum 1 is transferred (primarily transferred) onto the intermediate transfer belt 31.

In addition, a secondary transfer roller 33 as a secondary transfer unit is arranged on a side of an outer peripheral surface of the intermediate transfer belt 31. Furthermore, a bias having an opposite polarity to the normal charging polarity of the toner is applied to the secondary transfer roller 33 from a secondary transfer bias power supply (a high-voltage power supply) as a secondary transfer bias applying unit (not illustrated). Accordingly, a toner image on the intermediate transfer belt 31 is transferred (secondarily transferred) onto the recording material 12. For example, when forming a full-color image, the process described above is sequentially performed by the image forming portions SY, SM, SC, and SK, and toner images of the respective colors are primarily transferred onto the intermediate transfer belt 31 by being sequentially superimposed on top of one another. Subsequently, the recording material 12 is transported to a secondary transfer portion in synchronization with a movement of the intermediate transfer belt 31. In addition, due to an action of the secondary transfer roller 33 in contact with the intermediate transfer belt 31 via the recording material 12, the four-color toner images on the intermediate transfer belt 31 are collectively secondarily transferred onto the recording material 12.

The recording material 12 onto which the toner images have been transferred is transported to a fixing apparatus 34 as a fixing unit. Heat and pressure are applied to the recording material 12 by the fixing apparatus 34 to fix the toner images onto the recording material 12.

Drum Cartridge

A configuration of the drum cartridge 210 to be mounted to the image forming apparatus 100 according to the present embodiment will be described. FIG. 2 is a sectional (a main sectional) view of the drum cartridge 210 according to the present embodiment as viewed along a longitudinal direction (a rotational axis direction) of the photosensitive drum 1.

The photosensitive drum 1 is rotatably attached to the drum cartridge 210 via a bearing (not illustrated). The photosensitive drum 1 is rotationally driven in a direction of an illustrated arrow A in accordance with an image forming operation by receiving a driving force of a drive motor as a photosensitive drum driving unit (a driving source M210).

As the photosensitive drum 1, an organic photosensitive member is used in which an outer circumferential surface of an aluminum cylinder with a 30 mm-diameter is sequentially coated with an undercoat layer, a high-resistance layer, a carrier layer, and a carrier transfer layer which are functional membranes. Since the carrier transfer layer is shaved and worn down by image forming operations, a film thickness in accordance with a lifetime of the drum cartridge 210 must be formed. To accommodate recent market demands, the present embodiment adopts a film thickness of 25 μm in order to achieve a prolonged lifetime.

In addition, the charging roller 2 and the cleaning blade 6 formed by an elastic body are arranged in the drum cartridge 210 so as to come into contact with a peripheral surface of the photosensitive drum 1. Furthermore, the drum cartridge frame body 11 having a storage space for storing toner on the photosensitive drum 1 having been removed by the cleaning blade 6 is provided. A bias sufficient for causing an arbitrary charge to be carried on the photosensitive drum 1 is applied to the charging roller 2 from a charging bias power supply (a high-voltage power supply) as a charging bias applying unit (not illustrated). In the present embodiment, the applied bias is set so that a potential (a charging potential: Vd) on the photosensitive drum 1 is −500 V. A laser beam 35 is irradiated from the scanner unit 30 based on image information and forms an electrostatic image (an electrostatic latent image) on the photosensitive drum 1. As a result of the irradiation of the laser beam 35, in the irradiated portion, charges on the surface of the photosensitive drum 1 are eliminated by a carrier from the carrier generation layer and potential drops. Consequently, an electrostatic latent image is formed in which the irradiated portion by the laser beam 35 has prescribed light portion potential (V1) and a nonirradiated portion has prescribed dark portion potential (Vd).

In addition, the drum cartridge 210 is provided with a nonvolatile memory (hereinafter, referred to as an O memory m1) which is a storage unit. The O memory m1 stores information such as the number of rotations, a serial number, and the like of the photosensitive drum 1 and, based on the information stored in the O memory m1, a use amount of the drum cartridge can be assessed. The O memory m1 is configured so as to be capable of communicating (writing and reading information) with a control portion 300 of the image forming apparatus 100 illustrated in FIG. 1 in a contactless manner or by contact via an electrical contact (not illustrated).

Developing Cartridge

Next, a configuration of the developing cartridge 200 to be mounted to the image forming apparatus 100 according to the present embodiment will be described. FIG. 3 is a sectional (a main sectional) view of the developing cartridge 200 according to the present invention as viewed along a longitudinal direction (a rotational axis direction) of the developing roller 4.

The developing cartridge 200 is constituted by the developing chamber 20*a* and the developer storage chamber 20*b*, the developing roller 4, the toner supplying roller 5, and the developer container 22 constituting the developing chamber 20*a* and the developer storage chamber 20*b*. The developer storage chamber 20*b* is arranged below the developing chamber 20*a*. Toner 9 as a developer is stored inside the developer storage chamber 20*b*. In the present embodiment, negative polarity is used as a normal charging polarity of the toner 9 and, hereinafter, a case where a negative-charging toner is used will be described. However, the present invention is not limited to a negative-charging toner.

In addition, the developer storage chamber 20*b* is provided with a developer transport member 21 for transporting the toner 9 to the developing chamber 20*a*, and the developer transport member 21 transports the toner 9 to the developing chamber 20*a* by rotating in a direction of an illustrated arrow G. The developer transport member 21 is constituted by a sheet-shaped member having elasticity which extends in a cartridge longitudinal direction.

The developing chamber 20*a* is provided with the developing roller 4 as a developer bearing member which comes into contact with a corresponding photosensitive drum 1 and which rotates in a direction of an illustrated arrow D by receiving a driving force from a drive motor as a development driving unit (a driving source M200). In the present embodiment, the developing roller 4 and the photosensitive drum 1 respectively rotate so that surfaces thereof move in a same direction at an opposing portion (a contact portion). In addition, the developing roller 4 is constructed such that a conductive elastic rubber layer having a prescribed volume resistance is provided around a metal core. Furthermore, a bias sufficient to develop and visualize an electrostatic latent image on the photosensitive drum 1 as a toner image is applied from a developing bias power supply (a high-voltage power supply) as a developing bias applying unit (not illustrated).

In addition, a toner supplying roller (hereinafter, simply referred to as a "supplying roller") 5 which supplies the toner transported from the developer storage chamber 20*b* to the developing roller 4 and a toner amount control member (hereinafter, simply referred to as a "control member") 8 which controls a coating amount and provides a charge to the toner on the developing roller 4 having been supplied by the supplying roller 5 are arranged inside the developing chamber 20*a*.

Furthermore, the developing cartridge 200 is provided with a nonvolatile memory (hereinafter, referred to as a DT memory m2) which is a storage unit. The DT memory m2 stores a total drive amount, a remaining toner amount, and the like of the developing roller 4 and, based on the information stored in the DT memory m2, a use amount of the developing cartridge can be assessed. The remaining toner amount is an amount of toner that remains among toner stored inside the developing cartridge 200. The DT memory m2 is configured so as to be capable of communicating (writing and reading information) with the control portion 300 of the image forming apparatus 100 in a contactless manner or by contact via an electrical contact (not illustrated).

Image Formation Modes

The image forming apparatus 100 according to the present embodiment has two image formation modes. A first mode is an image formation mode (hereinafter, referred to as a normal mode) for obtaining normal image density. A second mode is an image formation mode (hereinafter, a high-density mode) for obtaining high density or increasing a tint selection range by increasing a rotational peripheral velocity ratio between the photosensitive drum 1 as an image bearing member and the developing roller 4 as a developer bearing member while lowering a dark portion potential on the image bearing member. As described above, the rotational peripheral velocity ratio (a second peripheral velocity ratio) in the second mode is larger than the rotational peripheral velocity ratio (a first peripheral velocity ratio) in the first mode.

A specific difference in control between the normal mode and the high-density mode according to the present embodiment is shown in Table 1 below.

TABLE 1

| | Dark portion potential Vd | Light portion potential Vl | Developing potential Vdc | Rotational peripheral velocity ratio |
|---|---|---|---|---|
| Normal mode | −500 | −100 | −300 | 1.4 |
| High-density mode | −700 | −150 | −500 | 2.5 |

In Table 1, a dark portion potential Vd represents a potential on the surface of the photosensitive drum 1 after charging the surface of the photosensitive drum 1 with the charging roller 2. In addition, a light portion potential Vl represents a potential on the surface of the photosensitive drum 1 after irradiating the laser beam 35. A developing potential Vdc represents a potential that is applied to the developing roller 4 by the developing bias power supply.

The rotational peripheral velocity ratio according to the present embodiment is a rotational peripheral velocity ratio of the developing roller 4 when a rotational peripheral velocity of the photosensitive drum 1 is 1. Specifically, in the normal mode, the rotational peripheral velocity of the photosensitive drum 1 is set to 200 mm/sec and the rotational peripheral velocity of the developing roller 4 is set to 280 mm/sec. Meanwhile, in the high-density mode, the rotational peripheral velocity of the photosensitive drum 1 is set to 100 mm/sec and the rotational peripheral velocity of the developing roller 4 is set to 250 mm/sec. The rotational peripheral velocity of the photosensitive drum 1 is made slower in the high-density mode in order to secure favorable fixability given that the toner amount on the recording material 12 has been increased. Although heat applied to the recording material 12 in the fixing apparatus 34 may be increased, since this also increases power consumption, the rotational peripheral velocity of the photosensitive drum 1 is reduced in the present embodiment.

As shown in Table 1, compared to the normal mode, a difference between the developing potential Vdc and the light portion potential Vl (hereinafter, referred to as a development contrast) is set greater in the high-density mode. Accordingly, compared to the normal mode, a larger amount of toner is developed onto the photosensitive drum 1 among toner coating the developing roller 4 in the high-density mode. In addition, by setting a large rotational peripheral velocity ratio between the photosensitive drum 1 and the developing roller 4, a toner amount supplied from the developing roller 4 per unit area of the photosensitive drum 1 increases. Due to these two effects, a toner amount on the recording material 12 can be increased and an image with high density and a high color gamut can now be printed.

Remaining Toner Amount Detecting Method

Figure 4:
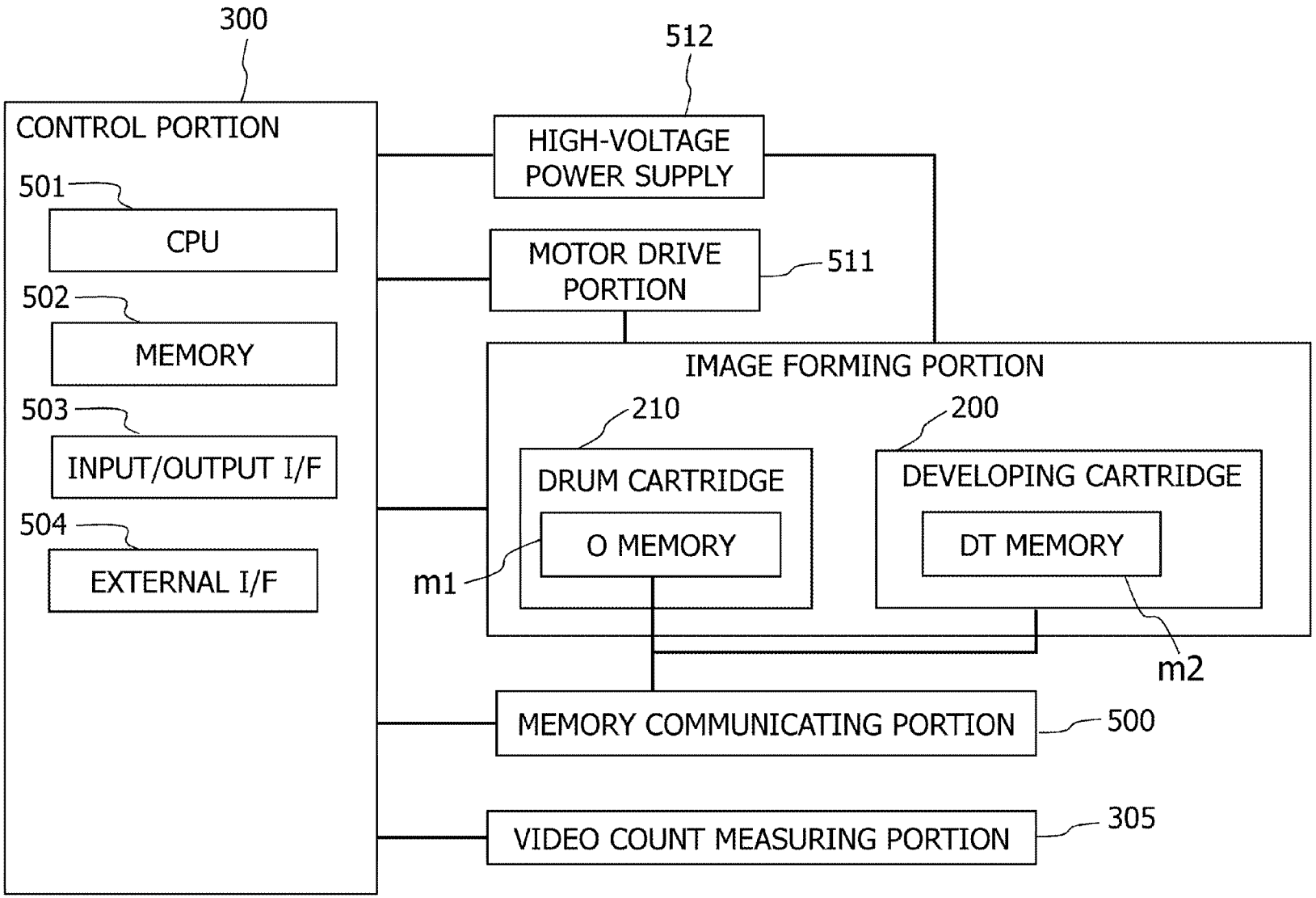
FIG. 4 is a hardware block diagram of an image forming apparatus.

A remaining toner amount detecting method by a video count system used in the present embodiment will now be described. FIG. 4 is a hardware block diagram of an image forming apparatus according to the present embodiment. The control portion 300 of the image forming apparatus 100 is provided with a CPU 501 which performs various calculation processes and which also functions as a correction information acquisition portion that acquires correction amount information such as a correction distance of the developing roller 4 and a remaining amount acquisition portion that acquires information on a remaining toner amount to be described later. In addition, an image forming apparatus main body-side memory 502 storing information necessary to control a motor drive portion 511 and a high-voltage power supply 512 is also provided. Furthermore, communication with the control portion 300 is performed by inputting and outputting information stored in the O memory m1 of the drum cartridge 210 and the DT memory m2 of the developing cartridge 200 to and from the CPU 501 from an input/output I/F 503 via a memory communicating portion 500. Moreover, a video count measuring portion 305 which measures a video signal output in accordance with an image forming operation is connected to the control portion 300.

A principle of remaining toner amount detection using a video count will now be described. A separate control apparatus (not illustrated) is arranged on an upstream side of the control portion 300, and a laser drive signal (a video signal) from the control apparatus is branched and the video signal is sampled during a period in which an electrostatic latent image is formed on the photosensitive drum. Sampled video signals are input to a hardware counter inside the control portion 300, and the number of ONs among ON/OFF of video signals is counted and a value thereof is read by the CPU 501. The read value indicates consumption of toner, and a value obtained by progressively subtracting the count value from a prescribed initial value is information indicating the remaining toner amount. In addition, by dividing the number of ONs of the video signals by the count number of ONs measured when a fully black image is hypothetically printed in a region where an image is to be printed on the recording material, a ratio representing how long a laser beam had been lighted in order to form an electrostatic latent image can be obtained. The electrostatic latent image is formed in a portion irradiated by the laser beam, and since toner adheres to the portion, a remaining toner amount can be calculated on the basis of the lighting ratio of the laser beam. While the count by the video count measuring portion 305 specifically corresponds to a count of ON video signals during which the laser beam is irradiated, a sampling period thereof need not be in synchronization with a video clock of the video signals. If sampling is to be performed at a shorter period than the video clock, the video count measuring portion 305 may count pixel information asynchronously with the video clock. In addition, the CPU 501 provided in the control portion 300 calculates a remaining amount of the toner 9 inside the developing cartridge 200 from the measured video count value.

The video count measuring portion 305 measures pixel information (a video count value VCn) of an output image. In the present embodiment, one sheet of the output recording material 12 is adopted as one video count value VCn. The CPU 501 calculates the remaining toner amount according to the following procedure. First, the video count value VCn measured by the video count measuring portion 305 is added to a cumulative video count value VCr from the start of use of the developing cartridge 200 stored in the DT memory m2 of the developing cartridge 200 to calculate a total video count value VCt.

$$VCt=VCr+VCn$$

Next, the CPU 501 calculates a remaining toner amount TP inside the developing cartridge 200 from a video count threshold value VCth stored in the DT memory m2 and the total video count value VCt.

$$TP[\%]=(1-VCt/VCth)\times 100$$

Subsequently, the CPU 501 writes the total video count value VCt into the DT memory m2 as the cumulative video count value VCr.

At this point, a remaining toner amount TP of 100% represents a state where the toner 9 inside the developing cartridge 200 is full and the developing cartridge 200 is brand new. In addition, a remaining toner amount TP of 0% represents a state where a remaining amount of the toner 9 inside the developing cartridge 200 is almost zero and a time for replacement of the developing cartridge 200 has arrived.

In the present embodiment, the video count threshold value VCth when the remaining toner amount TP is 0% is set on the basis of a remaining amount of the toner 9 which prevents toner supply from the supplying roller 5 to the developing roller 4 from becoming deficient even when a high-print image such as a solid image is printed. Therefore, for example, TP may be set to 5% as an actual remaining toner amount.

Developing Roller Lifespan Calculation Method

Next, a method of calculating a lifetime of the developing roller 4 will be described. The lifetime of the developing roller 4 is determined in accordance with a travel distance Wu of the developing roller 4. While a description will be given below using the travel distance Wu as an example of drive amount information indicating how much the developing roller 4 has been driven, various parameters can be used as the drive amount information as long as the parameters indicate how much the developing roller 4 has been driven. For example, a total drive time of the developing cartridge 200 may be used or a total number of rotations of the developing roller 4 may be used. Alternatively, the number of prints formed using the developing cartridge 200 may be used.

The image forming apparatus 100 is provided with a developing roller travel distance measuring portion 302 which measures the travel distance Wu of the developing roller 4, and the CPU 501 corrects the measured travel distance Wu of the developing roller 4 using a developing roller travel distance correction coefficient k.

The developing roller travel distance measuring portion 302 calculates the travel distance Wu from a drive time Td of the developing cartridge 200, a processing speed Ps of the image forming apparatus 100, and a peripheral velocity ratio Sr of the developing roller 4 with respect to the photosensitive drum 1.

$$Wu=Td\times Ps\times Sr$$

In this case, the travel distance Wu represents how far a given point on a surface of the developing roller 4 has advanced due to rotation of the developing roller 4. In addition, the processing speed Ps of the image forming apparatus 100 refers to a rotational speed of the photosensitive drum 1.

The CPU 501 reads the developing roller travel distance correction coefficient k that is the first correction coefficient stored in the DT memory m2. The CPU 501 may read the developing roller travel distance correction coefficient k (the second correction coefficient) in accordance with information related to a use amount of the developing cartridge 200. The information related to the use amount of the developing cartridge 200 may include information such as a cumulative number of rotations of the developing roller 4, a cumulative rotating time of the developing roller 4, a use amount of toner, and the remaining toner amount TP. The use amount of toner is an amount of the toner 9 used among the toner 9 stored inside the developing cartridge 200. The remaining toner amount TP is an amount of the toner 9 that remains among the toner 9 stored inside the developing cartridge 200. The use amount of toner may be obtained by subtracting the remaining toner amount TP from the amount of toner inside the developing cartridge 200 prior to the start of use. The remaining toner amount TP may be obtained by subtracting the use amount of toner from the amount of toner inside the developing cartridge 200 prior to the start of use. The information related to the use amount of the developing cartridge 200 may be a value obtained by dividing the cumulative number of rotations or the cumulative rotating time of the developing roller 4 by a first prescribed value related to the developing roller 4. The first prescribed value related to the developing roller 4 is the number of rotations or a rotating time of the developing roller 4 and is a value that is set on the basis of the lifetime of the developing roller 4. The information related to the use amount of the developing cartridge 200 may be a value obtained by dividing the use amount of toner by an amount of toner inside the developing cartridge 200 prior to the start of use. The information related to the use amount of the developing cartridge 200 may be a value obtained by dividing the remaining toner amount TP by the amount of toner inside the developing cartridge 200 prior to the start of use. Based on the information retained in the DT memory m2, the CPU 501 can acquire information related to the use amount of the developing cartridge 200.

The CPU 501 may read the developing roller travel distance correction coefficient k (the third correction coefficient) in accordance with the image formation mode. Specifically, the CPU 501 reads the developing roller travel distance correction coefficient k in accordance with the rotational peripheral velocity ratio between the photosensitive drum 1 and the developing roller 4. For example, the developing roller travel distance correction coefficient k read by the CPU 501 may be set such that k=1 in the normal mode and k=1.5 in the high-density mode. In addition, the CPU 501 may read the developing roller travel distance correction coefficient k calculated by multiplying a correction coefficient k1 in accordance with the information related to a use amount of the developing cartridge 200 by a correction coefficient k2 in accordance with the image formation mode. The correction coefficients k1 and k2 are stored in the DT memory m2.

Furthermore, as a corrected distance acquiring unit, the CPU 501 calculates a post-correction developing roller travel distance Hu by multiplying a prescribed travel distance Wu by the developing roller travel distance correction coefficient k.

$$Hu=Wu\times k$$

Next, the CPU 501 progressively adds the post-correction developing roller travel distance Hu to a post-progressive addition developing roller travel distance $HT_{n-1}$ from the start of use of the developing cartridge 200 which is stored in the DT memory m2. Accordingly, the CPU 501 calculates a total post-correction developing roller travel distance $HT_n$ (n=1, 2, . . . , n, $HT_0$=0) corresponding to an aggregate corrected distance or, in other words, a latest post-progressive addition developing roller travel distance $HT_n$.

$$HT_n=HT_{n-1}+Hu$$

Subsequently, from the developing roller travel distance threshold value $Wth_1$ in the normal mode stored in the DT memory m2 and the latest post-progressive addition developing roller travel distance $HT_n$, the CPU 501 calculates a developing roller remaining lifetime DP1 in the normal mode using the following calculation formula.

$$DP1\ [\%]=(1-HT_n/Wth_1)\times 100$$

In addition, from the developing roller travel distance threshold value $Wth_2$ in the high-density mode stored in the DT memory m2 and the latest post-progressive addition developing roller travel distance $HT_n$, the CPU 501 calculates a developing roller remaining lifetime DP2 in the high-density mode using the following calculation formula.

$$DP2\ [\%]=(1-HT_n/Wth_2)\times 100$$

The developing roller travel distance threshold value $Wth_1$ (hereinafter, referred to as a travel distance threshold value $Wth_1$) in the normal mode is an example of the first lifetime threshold value related to the lifetime of the developing roller 4. The developing roller travel distance threshold value $Wth_2$ (hereinafter, referred to as a travel distance threshold value $Wth_2$) in the high-density mode is an example of the second lifetime threshold value related to the lifetime of the developing roller 4.

Subsequently, the latest post-progressive addition developing roller travel distance $HT_n$ (a lifetime determination value) is written into the DT memory m2 and updated as the post-progressive addition developing roller travel distance $HT_{n-1}$ at the time of a next lifetime determination.

It should be noted that a case where the developing roller remaining lifetime DP1 or DP2 is 100% represents a brand-new developing cartridge 200. In addition, a case where the developing roller remaining lifetime DP1 or DP2 is equal to or smaller than 0% represents an arrival of a replacement timing of the developing cartridge 200.

In the present embodiment, the travel distance threshold value $Wth_1$ in the normal mode is set on the basis of a developing roller travel distance at which a toner coating amount on the developing roller 4 is no longer sufficiently controlled by the control member 8 and fogging of toner to a white portion occurs due to control failure in the normal mode. The travel distance threshold value $Wth_2$ in the high-density mode is set on the basis of a developing roller travel distance at which image density non-uniformity due to banding is caused by slippage of the photosensitive drum 1 and the developing roller 4 when a peripheral velocity ratio between the photosensitive drum 1 and the developing roller 4 is set high in a prescribed state. The prescribed state is a state where, although a control failure significant enough to cause fogging of toner to a white portion has not occurred, a minor control failure has nevertheless occurred in a latter half of the lifetime of the developing roller 4.

A relationship between a travel distance of a developing roller, control failure, and banding will now be described. The supplying roller 5, the control member 8, and the surface of the photosensitive drum 1 are in contact with the developing roller 4, and a prescribed potential difference is being generated between the developing roller 4 and the supplying roller 5, the control member 8, and the surface of the photosensitive drum 1. At this point, a current flows to the developing roller 4 and a resistance value of the developing roller 4 rises (energization deterioration). When the resistance value of the developing roller 4 rises, charges held by the toner 9 on the developing roller 4 is less readily discharged and a charge amount of the toner 9 increases. When adhesion of the toner 9 to the developing roller 4 increases and the adhesion of the toner 9 exceeds a control force of the control member 8, the control member 8 is no longer able to sufficiently control the toner 9 and a control failure occurs.

Figure 5A:
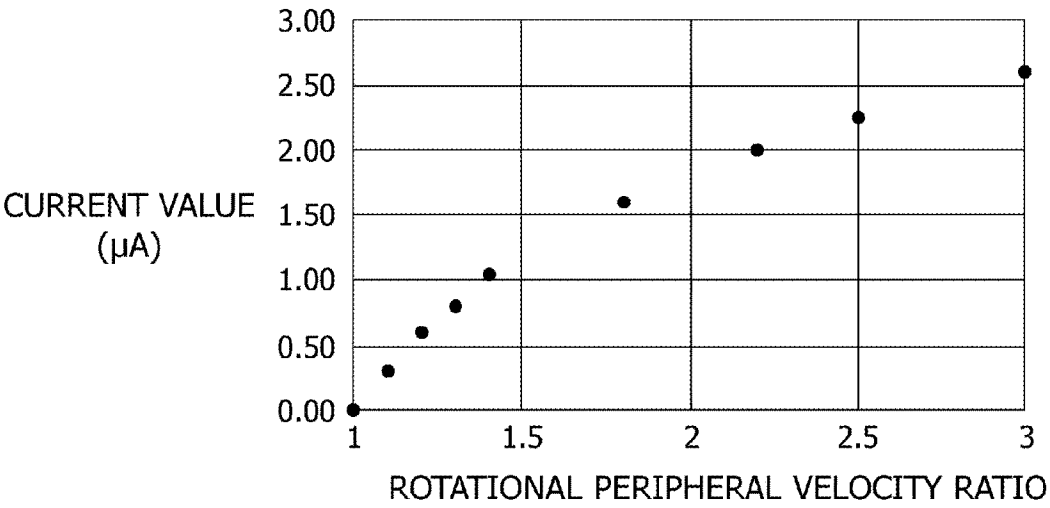
FIGS. 5A to 5C are explanatory diagrams of a relationship between a travel distance of a developing roller, control failure, and banding.

Energization deterioration changes in accordance with a magnitude of the current flowing to the developing roller 4. FIG. 5A is a graph showing a relationship between a rotational peripheral velocity ratio between the developing roller 4 and the photosensitive drum 1 and a current value of a current flowing from the photosensitive drum 1 to the developing roller 4. When the rotational peripheral velocity ratio between the photosensitive drum 1 and the developing roller 4 changes, as shown in FIG. 5A, the larger the rotational peripheral velocity ratio, the larger the current value of the current flowing to the developing roller 4. In other words, the larger the rotational peripheral velocity ratio, the further energization deterioration progresses. When there is a mode with a different rotational peripheral velocity ratio, a correction thereof must be made.

Figure 5B:
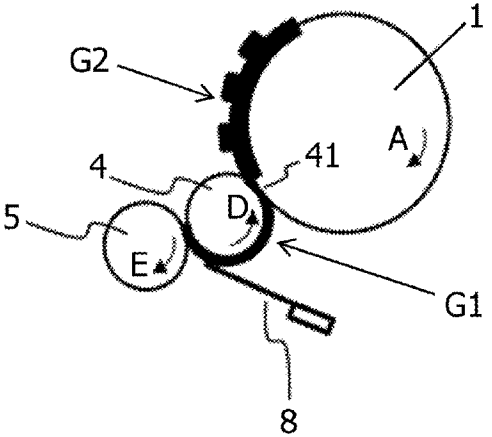
Figure 5C:
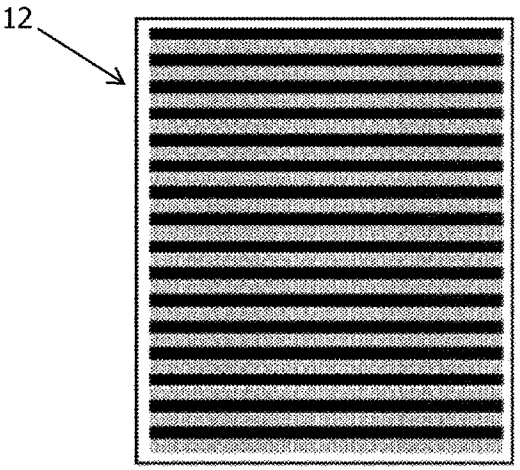

Referring to FIG. 5B, banding that occurs when the amount of toner on the developing roller 4 increases due to a control failure in the latter half of the lifetime of the developing roller 4 in a case where the high-density mode is set will be described. Due to a control failure, when the amount of toner on the developing roller 4 increases at a location indicated by an arrow G1 in FIG. 5B and, at the same time, the peripheral velocity ratio between the developing roller 4 and the photosensitive drum 1 increases, the developing roller 4 is no longer able to follow the rotation of the photosensitive drum 1 at a nip portion 41. Accordingly, as the developing roller 4 slips and non-uniformity in velocity occurs in the developing roller 4, non-uniformity in an amount of toner developed on the photosensitive drum 1 occurs at a location indicated by an arrow G2 in FIG. 5B. As a result, as shown in FIG. 5C, image density non-uniformity (banding) occurs over an entire image that is printed on the recording material 12. When there are modes with different peripheral velocity ratios between the photosensitive drum 1 and the developing roller 4 as is the case in the normal mode and the high-density mode, timings at which a control failure occurs differ. In addition, with respect to banding that occurs in the high-density mode, since the larger the peripheral velocity ratio, the earlier a timing at which the banding occurs, a developing roller travel distance threshold value must be set for each image formation mode. Furthermore, a degree of process of energization deterioration varies depending on characteristics of the developing roller 4. Since there is a possibility that specifications of the developing roller 4 may change, the developing roller travel distance threshold value in each image formation mode is preferably stored in the DT memory m2 mounted to the developing cartridge 200. However, storage of the developing roller travel distance threshold value in each image formation mode is not limited thereto and may be stored in a memory of the image forming apparatus main body instead.

Developing Cartridge Lifespan Determination Sequence

Figure 6A:
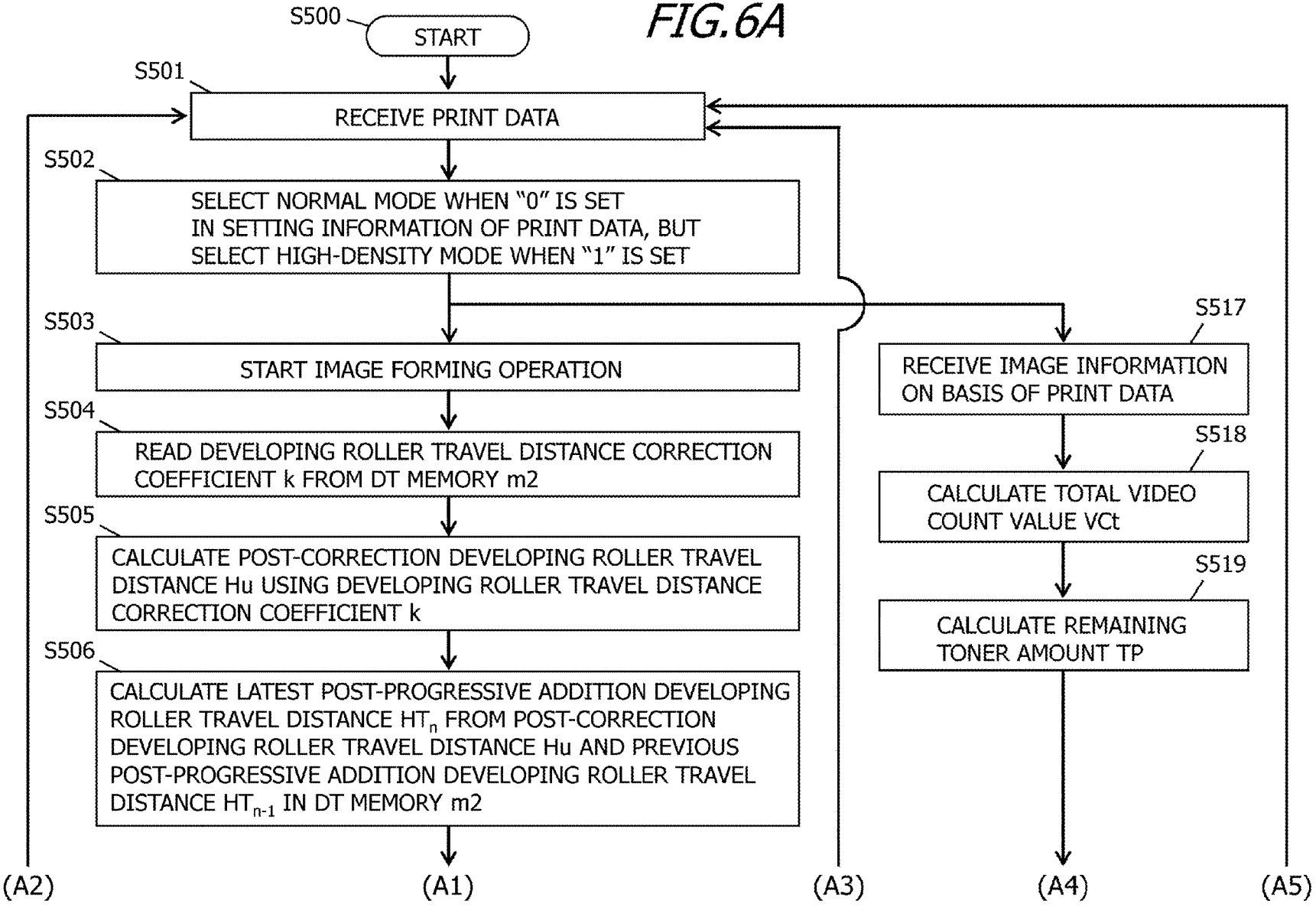
FIGS. 6A and 6B are sequence charts of lifetime determination of a developing cartridge.
Figure 6B:
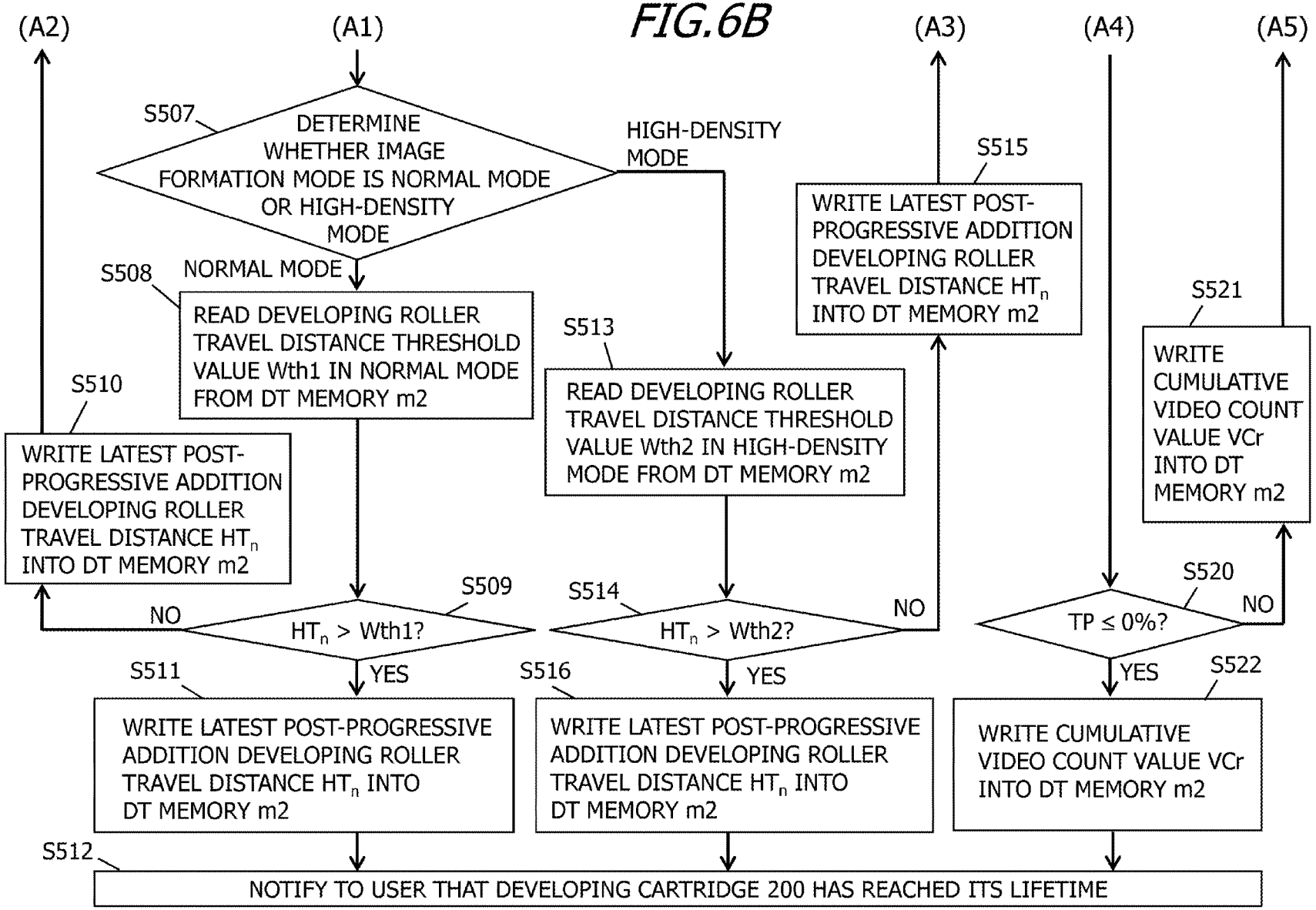

FIGS. 6A and 6B are sequence charts of lifetime determination of the developing cartridge 200 according to the first embodiment. By performing the processes shown in the flow charts in FIGS. 6A and 6B as a controller (a control unit) or a determination unit on the basis of information in the DT memory m2 mounted to the developing cartridge 200, the CPU 501 built into the control portion 300 determines a lifetime of the developing cartridge 200 and announces a determination result thereof to a user.

The flow charts shown in FIGS. 6A and 6B will be described. First, the image forming apparatus 100 receives print data on the basis of a document created by an external computer via an external I/F 504 (S501).

For example, the CPU 501 selects the normal mode when "0" is set in setting information included in the print data but selects the high-density mode when "1" is set in the setting information, and executes the subsequent processes (S502).

Next, the CPU 501 starts an image forming operation of the image forming apparatus 100 including the developing cartridge 200 (S503). The image forming operation at this point includes all operations necessary for image formation such as setting a charging potential of the charging roller 2, setting a developing potential of the developing roller 4, and rotationally driving the photosensitive drum 1 and the developing roller 4 having a prescribed rotational peripheral velocity ratio described with reference to Table 1. While the travel distance Wu is measured by the CPU 501 when drive of the developing roller 4 is started, such a measurement process is also included in the image forming operation at this point. In addition, the travel distance Wu measured when the normal mode is selected in S501 corresponds to the first drive amount information in the first mode, and the travel distance Wu measured when the high-density mode is selected in S501 corresponds to the second drive amount information in the second mode.

Next, the CPU 501 reads the developing roller travel distance correction coefficient k from the DT memory m2 (S504). As described earlier, the CPU 501 reads the developing roller travel distance correction coefficient k in accordance with the information related to a use amount of the developing cartridge 200 and/or the developing roller travel distance correction coefficient k in accordance with the image formation mode. When the CPU 501 reads the developing roller travel distance correction coefficient k in accordance with the image formation mode, for example, when the image formation mode is the high-density mode, the CPU 501 reads k=1.5, or when the image formation mode is the normal mode, the CPU 501 reads k=1. When the correction coefficient of the selected image formation mode is 1, since there is no need to perform correction, the CPU 501 may skip the process of S102.

Next, using the read developing roller travel distance correction coefficient k, the CPU 501 calculates the post-correction developing roller travel distance Hu (S505). A timing at which the CPU 501 calculates the post-correction developing roller travel distance Hu may be after end of print or at prescribed intervals. In any case, a calculation object is a non-computed travel distance Wu.

In addition, from the post-correction developing roller travel distance Hu and a previous post-progressive addition developing roller travel distance $HT_{n-1}$ stored in the DT memory m2, the CPU 501 calculates a latest post-progressive addition developing roller travel distance $HT_n$, as a lifetime determination value (S506).

Next, the CPU 501 determines whether the image formation mode is the normal mode or the high-density mode (S507). When the image formation mode is the normal mode, the CPU 501 reads the travel distance threshold value $Wth_1$ in the normal mode from the DT memory m2 (S508). Subsequently, the CPU 501 compares the latest post-progressive addition developing roller travel distance $HT_n$ with the travel distance threshold value $Wth_1$ in the normal mode and determines whether or not the latest post-progressive addition developing roller travel distance $HT_n$ has exceeded the travel distance threshold value $Wth_1$ in the normal mode (S509). In addition, when the latest post-progressive addition developing roller travel distance $HT_n$ has exceeded the travel distance threshold value $Wth_1$ in the normal mode, the CPU 501 writes the latest post-progressive addition developing roller travel distance $HT_n$ into the DT memory m2 (S511). Subsequently, using a notifying unit, the CPU 501 announces to the user via the external I/F 504 that the developing cartridge 200 has reached its lifetime (S512). While a main body display unit such as a monitor or an audio speaker is conceivable as the notifying unit, the notifying unit is not limited thereto and, for example, a message may be sent to an external apparatus such as a PC connected to the image forming apparatus.

In S509, while the lifetime of the developing roller 4 is determined using the travel distance threshold value $Wth_1$ in the normal mode stored in the DT memory m2, this method is not restrictive. The travel distance threshold value $Wth_2$ in the high-density mode and a developing roller lifetime threshold value correction coefficient C1 in the normal mode may be stored in the DT memory m2. In S508, the CPU 501 may read the travel distance threshold value $Wth_2$ in the high-density mode and the developing roller lifetime threshold value correction coefficient C1 in the normal mode and obtain a travel distance threshold value $Wth_{1-1}$ in the normal mode using the following calculation formula.

$$Wth_{1-1}=Wth_2\times C1$$

Subsequently, in S509, the CPU 501 may compare the latest post-progressive addition developing roller travel distance $HT_n$ with the travel distance threshold value $Wth_{1-1}$ in the normal mode and determine whether or not the latest post-progressive addition developing roller travel distance $HT_n$ has exceeded the travel distance threshold value $Wth_{1-1}$ in the normal mode. The travel distance threshold value $Wth_{1-1}$ in the normal mode is an example of the third lifetime threshold value related to the lifetime of the developing roller 4. It should be noted that the method of calculating the travel distance threshold value $Wth_{1-1}$ in the normal mode using the developing roller lifetime threshold value correction coefficient C1 in the normal mode similarly applies to FIGS. 7A to 9B to be described later. Table 2 below shows the travel distance threshold value $Wth_2$ in the high-density mode and the developing roller lifetime threshold value correction coefficient C1 in the normal mode. However, the numerical values shown in Table 2 are merely examples and are not restrictive.

TABLE 2

| | |
|---|---|
| Travel distance threshold value $Wth_2$ in high-density mode | 2400000[mm] |
| Developing roller lifetime threshold value correction coefficient C1 in normal mode | 1.25 |

While the CPU 501 determines the lifetime of the developing roller 4 on the basis of whether or not the latest post-progressive addition developing roller travel distance $HT_n$ has exceeded the travel distance threshold value $Wth_1$ in the normal mode in the description given above, the determination by the CPU 501 is not limited thereto. Specifically, in S509, the CPU 501 may obtain the developing roller remaining lifetime DP1 in the normal mode using the following calculation formula and determine the lifetime of the developing roller 4 on the basis of whether or not the developing roller remaining lifetime DP1 in the normal mode has fallen below 0 or a prescribed value.

$$DP1\ [\%]=(1-HT_n/Wth_1)\times 100$$

In addition, the CPU 501 may calculate the developing roller remaining lifetime DP1 using the travel distance threshold value $Wth_{1-1}$ in the normal mode. The method using the developing roller remaining lifetime DP1 in the normal mode similarly applies to FIGS. 8A and 8B to be described later.

In S509, when the latest post-progressive addition developing roller travel distance $HT_n$ has not exceeded the travel distance threshold value $Wth_1$ in the normal mode, the CPU 501 writes the latest post-progressive addition developing roller travel distance $HT_n$ into the DT memory m2 to update the post-progressive addition developing roller travel distance $HT_n$ (S510). In addition, the image forming apparatus 100 performs preparations for a next image formation. When $Wth_{1-1}$ is used in S509 and S510, the CPU 501 performs processes similar to those when using $Wth_1$.

When the image formation mode is the high-density mode, the CPU 501 reads the travel distance threshold value $Wth_2$ in the high-density mode from the DT memory m2 (S513). Subsequently, the CPU 501 compares the latest post-progressive addition developing roller travel distance $HT_n$ with the travel distance threshold value $Wth_2$ in the high-density mode and determines whether or not the latest post-progressive addition developing roller travel distance $HT_n$ has exceeded the travel distance threshold value $Wth_2$ in the high-density mode (S514). In addition, when the latest post-progressive addition developing roller travel distance $HT_n$ has exceeded the travel distance threshold value $Wth_2$ in the high-density mode, the CPU 501 writes the latest post-progressive addition developing roller travel distance $HT_n$ into the DT memory m2 (S516). Subsequently, using a notifying unit, the CPU 501 announces to the user via the external I/F 504 that the developing cartridge 200 has reached its lifetime (S512). After performing the notification process in S512, the CPU 501 may either permit or prohibit an image forming operation by the image forming apparatus 100 in the normal mode in accordance with an instruction from the user. Alternatively, after performing the notification process in S512, the CPU 501 may either permit or prohibit an image forming operation by the image forming apparatus 100 in the normal mode regardless of an instruction from the user.

While the lifetime of the developing roller 4 is determined using the travel distance threshold value $Wth_2$ in the high-density mode stored in the DT memory m2 in the description given above, this method is not restrictive. The travel distance threshold value $Wth_1$ in the normal mode and a developing roller lifetime threshold value correction coefficient C2 in the high-density mode may be stored in the DT memory m2. In S513, the CPU 501 may read the travel distance threshold value $Wth_1$ in the normal mode and the developing roller lifetime threshold value correction coefficient C2 in the high-density mode and obtain a travel distance threshold value $Wth_{2-1}$ in the high-density mode using the following calculation formula.

$$Wth_{2-1}=Wth_1\times C2$$

Subsequently, in S514, the CPU 501 may compare the latest post-progressive addition developing roller travel distance $HT_n$ with the travel distance threshold value $Wth_{2-1}$ in the high-density mode and determine whether or not the latest post-progressive addition developing roller travel distance $HT_n$ has exceeded the travel distance threshold value $Wth_{2-1}$ in the high-density mode. The travel distance threshold value $Wth_{2-1}$ in the high-density mode is an example of the fourth lifetime threshold value related to the lifetime of the developing roller 4. It should be noted that the method of calculating the travel distance threshold value $Wth_{2-1}$ in the high-density mode using the developing roller lifetime threshold value correction coefficient C2 in the high-density mode similarly applies to FIGS. 7A to 9B to be described later. Table 3 below shows the travel distance threshold value $Wth_1$ in the normal mode and the developing roller lifetime threshold value correction coefficient C2 in the high-density mode. However, the numerical values shown in Table 3 are merely examples and are not restrictive.

TABLE 3

| | |
|---|---|
| Travel distance threshold value $Wth_1$ in normal mode | 3000000[mm] |
| Developing roller lifetime threshold value correction coefficient C2 in high-density mode | 0.8 |

While the CPU 501 determines the lifetime of the developing roller 4 on the basis of whether or not the latest post-progressive addition developing roller travel distance $HT_n$ has exceeded the travel distance threshold value $Wth_2$ in the high-density mode in the description given above, the determination by the CPU 501 is not limited thereto. Specifically, in S514, the CPU 501 may obtain the developing roller remaining lifetime DP2 using the following calculation formula and determine the lifetime of the developing roller 4 on the basis of whether or not the developing roller remaining lifetime DP2 has fallen below 0 or a prescribed value.

$$DP2\ [\%]=(1-HT_n/Wth_2)\times 100$$

In addition, the CPU 501 may calculate the developing roller remaining lifetime DP2 using the travel distance threshold value $Wth_{2-1}$ in the high-density mode. The method using the developing roller remaining lifetime DP2 in the high-density mode similarly applies to FIGS. 8A and 8B to be described later.

In addition, a reference travel distance threshold value $Wth_R$, the developing roller lifetime threshold value correction coefficient C1 in the normal mode, and the developing roller lifetime threshold value correction coefficient C2 in the high-density mode may be stored in the DT memory m2. The reference travel distance threshold value $Wth_R$ is an example of the reference lifetime threshold value related to the lifetime of the developing roller 4.

In S508, the CPU 501 may read the reference travel distance threshold value $Wth_R$ and the developing roller lifetime threshold value correction coefficient C1 in the normal mode and obtain a travel distance threshold value $Wth_{1-2}$ in the normal mode using the following calculation formula.

$$Wth_{1-2}=Wth_R\times C1$$

Subsequently, in S509, the CPU 501 may compare the latest post-progressive addition developing roller travel distance $HT_n$ with the travel distance threshold value $Wth_{1-2}$ in the normal mode and determine whether or not the latest post-progressive addition developing roller travel distance $HT_n$ has exceeded the travel distance threshold value $Wth_{1-2}$ in the normal mode. The travel distance threshold value $Wth_{1-2}$ in the normal mode is an example of the third lifetime threshold value related to the lifetime of the developing roller 4. It should be noted that the method of using the travel distance threshold value $Wth_{1-2}$ in the normal mode similarly applies to FIGS. 7A to 9B to be described later.

In S513, the CPU 501 may read the reference travel distance threshold value $Wth_R$ and the developing roller lifetime threshold value correction coefficient C2 in the high-density mode and obtain a travel distance threshold value $Wth_{2-2}$ in the high-density mode using the following calculation formula.

$$Wth_{2-2}=Wth_R \times C2$$

Subsequently, in S514, the CPU 501 may compare the latest post-progressive addition developing roller travel distance $HT_n$ with the travel distance threshold value $Wth_{2-2}$ in the high-density mode and determine whether or not the latest post-progressive addition developing roller travel distance $HT_n$ has exceeded the travel distance threshold value $Wth_{2-2}$ in the high-density mode. The travel distance threshold value $Wth_{2-2}$ in the high-density mode is an example of the fourth lifetime threshold value related to the lifetime of the developing roller 4. It should be noted that the method of using the travel distance threshold value $Wth_{2-2}$ in the high-density mode similarly applies to FIGS. 7A to 9B to be described later.

In S514, when the latest post-progressive addition developing roller travel distance $HT_n$ which is a total post-correction developing roller travel distance has not exceeded the travel distance threshold value $Wth_2$, the CPU 501 writes the latest post-progressive addition developing roller travel distance $HT_n$ into the DT memory m2 to update the post-progressive addition developing roller travel distance $HT_n$ (S515). In addition, the image forming apparatus 100 performs preparations for a next image formation.

Meanwhile, after receiving image information on the basis of print data (S517), the CPU 501 measures the video count value VC with the video count measuring portion 305 and calculates the total video count value VCt (S518). Subsequently, the CPU 501 calculates the remaining toner amount TP (S519), and determines whether or not the remaining toner amount is small or, in other words, whether the remaining toner amount TP is equal to or lower than 0% (whether or not the remaining toner amount TP is equal to or lower than a prescribed threshold value remaining amount) (S520). When the remaining toner amount TP has reached 0% or lower, the CPU 501 writes the cumulative video count value VCr in the DT memory m2 (S522), and announces to the user that the developing cartridge 200 has reached its lifetime (S512). Meanwhile, when the remaining toner amount TP has not reached 0% or lower, the CPU 501 writes the cumulative video count value VCr in the DT memory m2 (S521). In addition, the image forming apparatus 100 performs preparations for a next image formation.

While calculating the remaining toner amount TP has been described as a method of determining whether or not the remaining toner amount is small, the method is not restrictive. For example, since the total video count value VCt indicates toner consumption itself, the CPU 501 may determine whether or not the total video count value VCt exceeds a prescribed threshold value set in advance and determine whether or not the remaining toner amount is small. In addition, while a remaining toner amount detection method according to a video count system has been described as an example, this example is not restrictive. For example, a remaining amount detecting system using capacitance, a light-transmission remaining amount detecting system, or a combination thereof may be used. Specifically, when the remaining toner amount acquired by the video count system is equal to or smaller than a prescribed remaining amount, any of a capacitance system and a light transmission system may be used. In other words, a configuration may be adopted in which a more suitable remaining amount acquisition method is selected in accordance with a degree of the remaining toner amount. It should be noted that the capacitance system refers to a method of acquiring an amount of the toner 9 on the basis of a change in detected capacitance using an electrode of which a detected capacitance changes in accordance with a change in a state of the toner 9 inside the developer storage chamber (for example, by pasting a conductive member on an inner wall of the chamber). Since this is a conventional and well-known method, a detailed description thereof will be omitted. In addition, the light-transmission system refers to a system which uses a light source that irradiates the inside of the developer storage chamber with light and a light receiving portion that receives light having passed inside the chamber and which acquires an amount of the toner 9 on the basis of a change in a light reception state of the light receiving portion. Since this method is also conventional and well-known, a detailed description thereof will be omitted. A similar description also applies to the flow charts to be described later.

In the first embodiment in which the series of flow charts are to be executed, a travel distance threshold value Wt of the developing roller 4 is set in accordance with the image formation mode. Accordingly, the lifetime of the developing cartridge 200 can be properly determined and announced to the user. In addition, by also using a detection result of the remaining toner amount, the fact that an amount of toner inside the developing cartridge 200 is almost zero is also detected. Accordingly, not only the lifetime of the developing roller 4 due to energization deterioration but the lifetime of the developing cartridge 200 on the basis of a remaining amount of the toner 9 can also be announced in conjunction, and the lifetime of the developing cartridge 200 can be more properly announced to the user.

First Alternative Developing Cartridge Lifespan Determination Sequence

In the description of FIGS. 6A and 6B, a method is described in which a latest post-progressive addition developing roller travel distance (a total travel distance) $HT_n$ is obtained as needed by progressively adding the post-correction developing roller travel distance Hu to $HT_{n-1}$ corresponding to a previous total post-correction developing roller travel distance to determine the lifetime of the developing roller 4. However, this method is not restrictive. For example, the CPU 501 progressively subtracts the post-correction developing roller travel distance Hu from a developing roller travelable distance TD (Total Distance) as an initial value at the start of use of the developing cartridge 200 which is stored in the DT memory m2. Accordingly, a travelable distance $HT'_n$ as a lifetime determination value for determining a lifetime of the developing roller 4 may be calculated. It should be noted that $HT_0$ matches the developing roller travelable distance TD as an initial value.

$$HT'_n=HT'_{n-1}-Hu$$

Figure 7A:
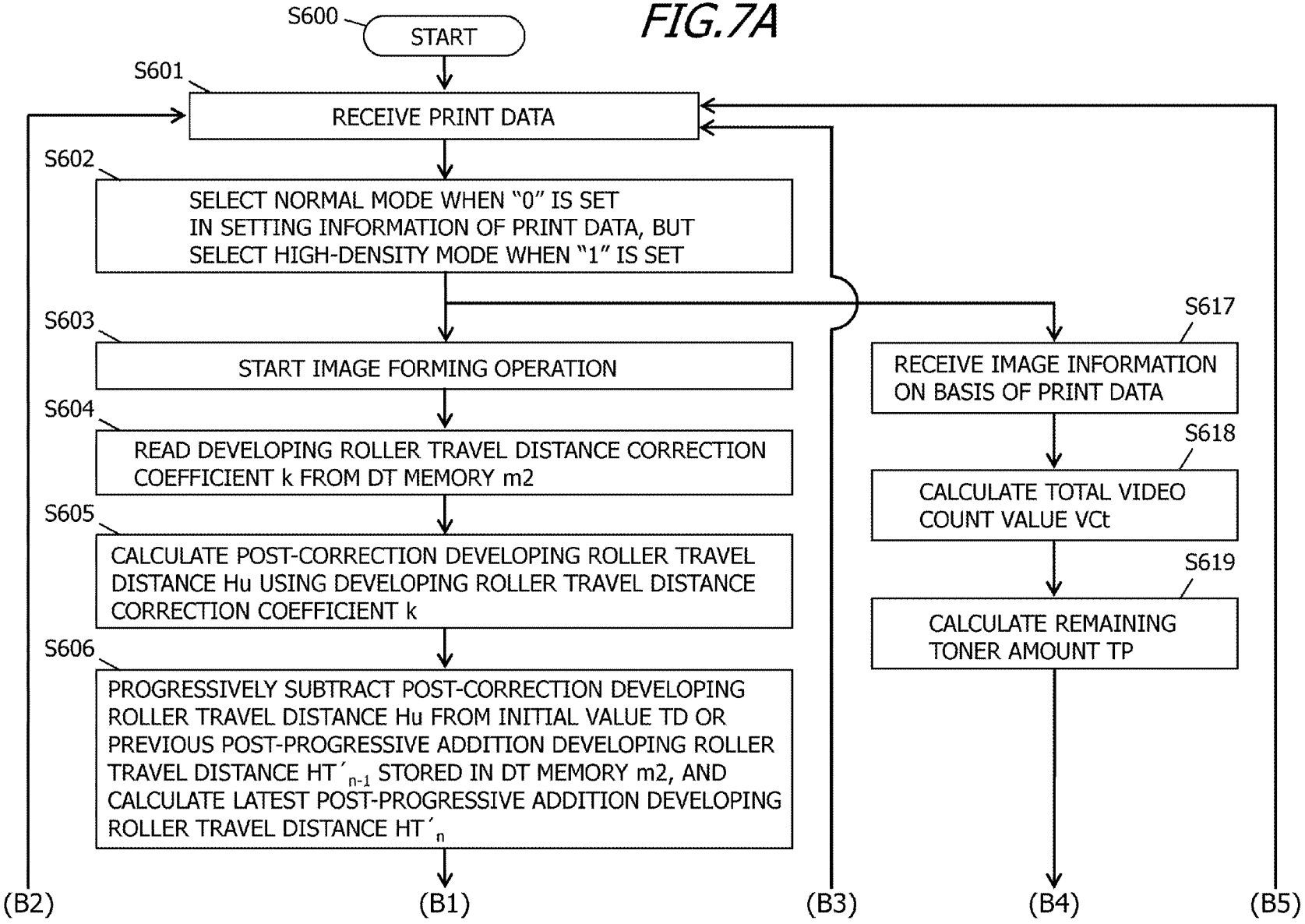
FIGS. 7A and 7B are sequence charts of another lifetime determination of a developing cartridge.

Hereinafter, a developing cartridge lifetime determination sequence in accordance with the progressive subtraction process by the CPU 501 will be described in detail with reference to the flow chart shown in FIGS. 7A and 7B. First, since processes of S601 to S605 in FIG. 7A are similar to the processes of S501 to S505 described with reference to FIG. 6A, a detailed description thereof will be omitted. Next, the post-correction developing roller travel distance Hu is progressively subtracted from an initial value (the developing roller travelable distance TD) or the previous travelable distance $HT'_{n-1}$ stored in the DT memory m2 to calculate a latest travelable distance $HT'_n$ (S606). The latest travelable distance $HT'_n$ corresponds to the lifetime determination value.

Figure 7B:
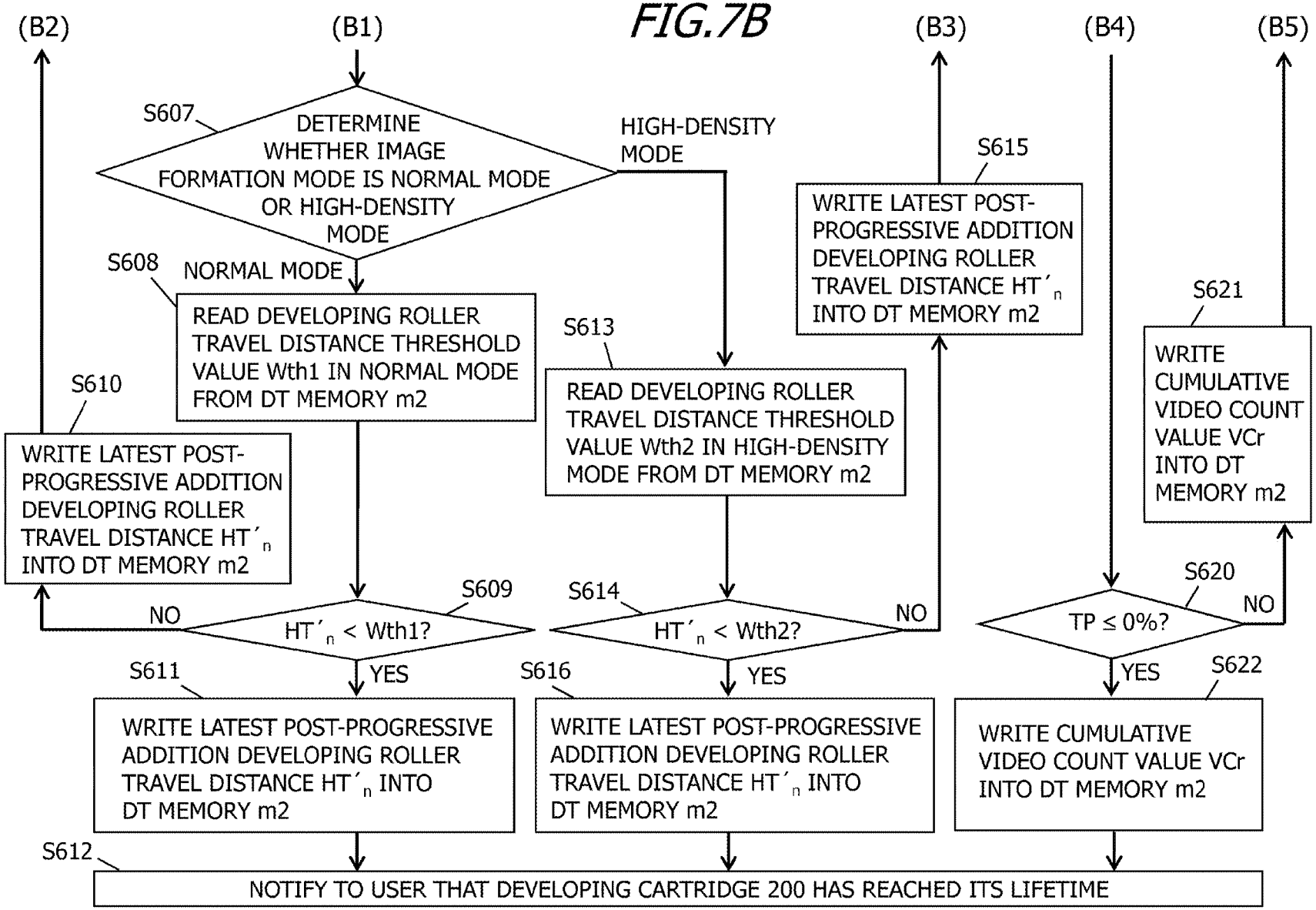

Since processes of S607 and S608 in FIG. 7B are similar to the processes of S507 and S508 described with reference to FIG. 6B, a detailed description thereof will be omitted. Subsequently, the CPU 501 compares the latest travelable distance $HT'_n$ with the travel distance threshold value $Wth_1$ in the normal mode and determines whether or not the latest travelable distance $HT'_n$ has fallen below the travel distance threshold value $Wth_1$ in the normal mode (S609). When the CPU 501 determines in S609 that the travelable distance $HT'_n$ has fallen below the travel distance threshold value $Wth_1$ in the normal mode, the CPU 501 writes the travelable distance $HT'_n$ after progressive subtraction into the DT memory m2 (S611). Subsequently, using a notifying unit, the CPU 501 announces to the user via the external I/F 504 that the developing cartridge 200 has reached its lifetime (S612).

In S609, while the CPU 501 determines the lifetime of the developing roller 4 on the basis of whether or not the travelable distance $HT'_n$ has fallen below the travel distance threshold value $Wth_1$ in the normal mode, the determination by the CPU 501 is not limited thereto. Specifically, in S609, the CPU 501 may obtain a developing roller remaining lifetime DP1' in the normal mode using the following calculation formula and determine the lifetime of the developing roller 4 on the basis of whether or not the developing roller remaining lifetime DP1' in the normal mode has fallen below 0 or a prescribed value.

$$DP1'[\%]=(HT'_n/Wth_1)\times 100$$

The method using the developing roller remaining lifetime DP1' in the normal mode similarly applies to FIGS. 9A and 9B to be described later.

In S609, when the latest travelable distance $HT'_n$ has not fallen below the travel distance threshold value $Wth_1$ in the normal mode, the CPU 501 writes the latest travelable distance $HT'_n$ into the DT memory m2 to update the travelable distance $HT'_n$ (S610). In addition, the image forming apparatus 100 performs preparations for a next image formation.

Since the process of S613 in FIG. 7B is similar to the process of S513 described with reference to FIG. 6B, a detailed description thereof will be omitted. Subsequently, the CPU 501 compares the latest travelable distance $HT'_n$ with the travel distance threshold value $Wth_2$ in the high-density mode and determines whether or not the latest travelable distance $HT'_n$ has fallen below the travel distance threshold value $Wth_2$ in the high-density mode (S614). When the CPU 501 determines in S614 that the travelable distance $HT'_n$ has fallen below the travel distance threshold value $Wth_2$ in the high-density mode, the CPU 501 writes the travelable distance $HT'_n$ after progressive subtraction into the DT memory m2 (S616). Subsequently, using a notifying unit, the CPU 501 announces to the user via the external I/F 504 that the developing cartridge 200 has reached its lifetime (S612). After performing the notification process in S612, the CPU 501 may either permit or prohibit an image forming operation by the image forming apparatus 100 in the normal mode in accordance with an instruction from the user. Alternatively, after performing the notification process in S612, the CPU 501 may either permit or prohibit an image forming operation by the image forming apparatus 100 in the normal mode regardless of an instruction from the user.

In S614, when the latest travelable distance $HT'_n$ has not fallen below the travel distance threshold value $Wth_2$ in the high-density mode, the CPU 501 writes the latest travelable distance $HT'_n$ into the DT memory m2 to update the travelable distance $HT'_n$ (S615). In addition, the image forming apparatus 100 performs preparations for a next image formation. Since other processes are similar to the processes in the flow charts shown in FIGS. 6A and 6B, a detailed description thereof will be omitted.

In S614, while the CPU 501 determines the lifetime of the developing roller 4 on the basis of whether or not the travelable distance $HT'_n$ has fallen below the travel distance threshold value $Wth_2$ in the high-density mode, the determination by the CPU 501 is not limited thereto. Specifically, in S614, the CPU 501 may obtain a developing roller remaining lifetime DP2' in the high-density mode using the following calculation formula and determine the lifetime of the developing roller 4 on the basis of whether or not the developing roller remaining lifetime DP2' in the high-density mode has fallen below 0 or a prescribed value.

$$DP2'[\%]=(HT'_n/Wth_2)\times 100$$

The method using the developing roller remaining lifetime DP2' in the high-density mode similarly applies to FIGS. 9A and 9B to be described later.

It should be noted that a frequency at which the processes of S604 to S616 are to be executed is not limited to a specific frequency. For example, the processes of S604 to S616 may be performed every second with respect to the travel distance Wu which is measured as needed by the CPU 501. Alternatively, every time a print job is completed, the processes of S604 to S616 may be performed with respect to the travel distance Wu measured from the start of the print job. Furthermore, the processes of S604 to S616 may be performed every time a prescribed number of a plurality of print jobs are completed. This description similarly applies to the processes of S504 to S516 shown in FIGS. 6A and 6B described earlier.

Second Alternative Developing Cartridge Lifespan Determination Sequence

In the description of FIGS. 6A, 6B, 7A and 7B given above, the CPU 501 is described to update the post-progressive addition developing roller travel distance $HT_n$ and the travelable distance $HT'_n$ as need at a prescribed frequency and determine whether the developing cartridge 200 has reached its lifetime. However, a similar effect can be produced through other lifetime determination sequences.

For example, a developing roller total travel distance $Wt_0$ in the normal mode and a developing roller total travel distance $Wt_1$ in the high-density mode may be respectively stored and the CPU 501 may determine the lifetime of the developing cartridge 200 on the basis of stored $Wt_0$ and $Wt_1$. Among suffixes of Wt, "0" signifies the normal mode and "1" signifies the high-density mode. Hereinafter, the aspect will be described in detail with reference to the flow charts shown in FIGS. 8A and 8B.

Figure 8A:
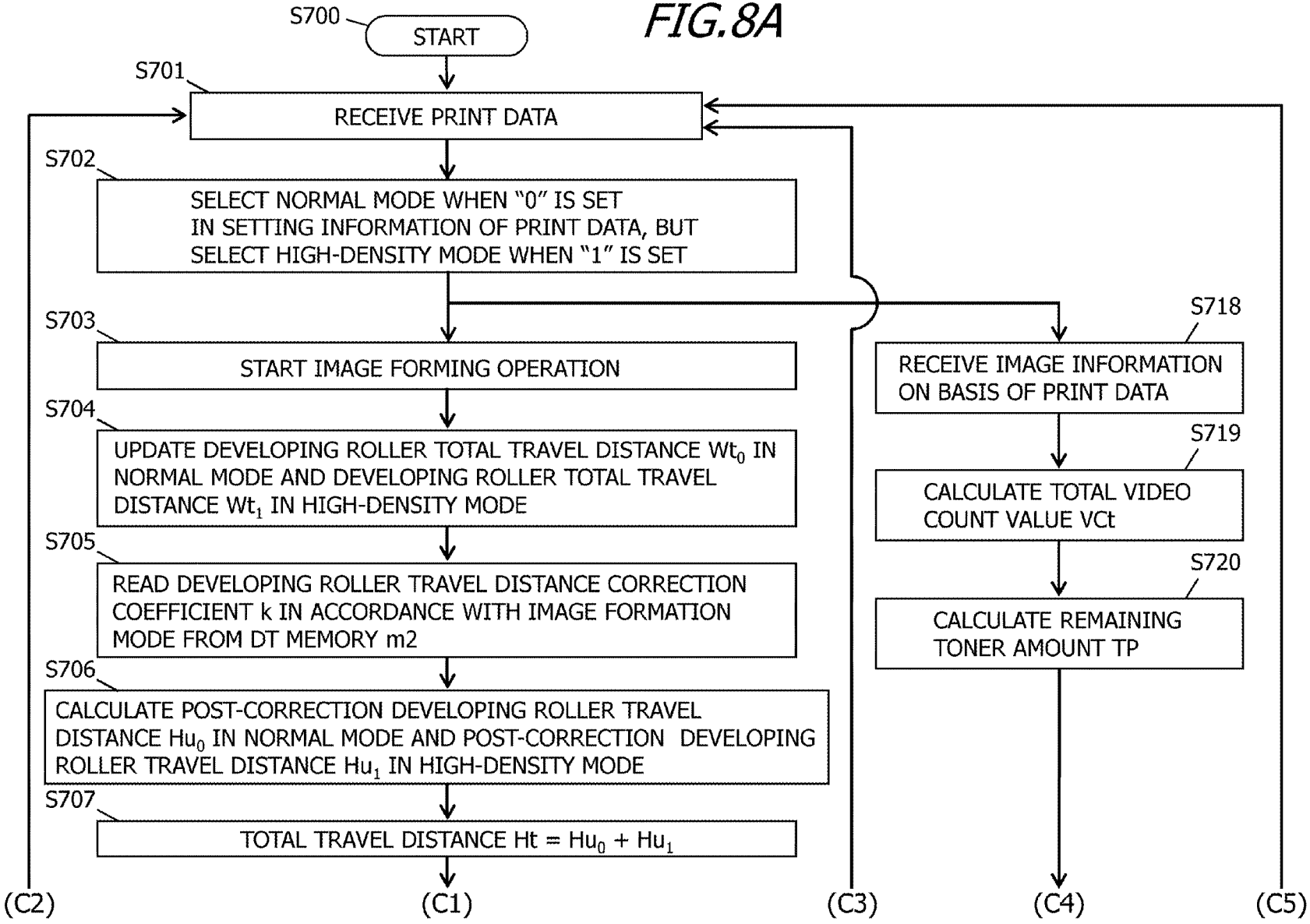
FIGS. 8A and 8B are sequence charts of another lifetime determination of a developing cartridge.

First, since processes of S701 to S703 in FIG. 8A are similar to the processes of S501 to S503 described with reference to FIG. 6A, a detailed description thereof will be omitted. Next, the CPU 501 updates $Wt_0$ or $Wt_1$ on the basis of the image formation mode selected in S702 and the travel distance Wu measured in S703 (S704). For example, when the image formation mode selected in S702 is the high-density mode, the CPU 501 adds the travel distance Wu measured in S703 to the developing roller total travel distance $Wt_1$ and acquires latest $Wt_0$ and $Wt_1$. In this case, $Wt_0$ corresponds to the first total value obtained by progressively adding the first drive amount information that is the travel distance Wu measured in the normal mode, and $Wt_1$ corresponds to the second total value obtained by progressively adding the second drive amount information that is the travel distance Wu measured in the high-density mode, and the terms will be hereinafter used in the following description.

Figure 8B:
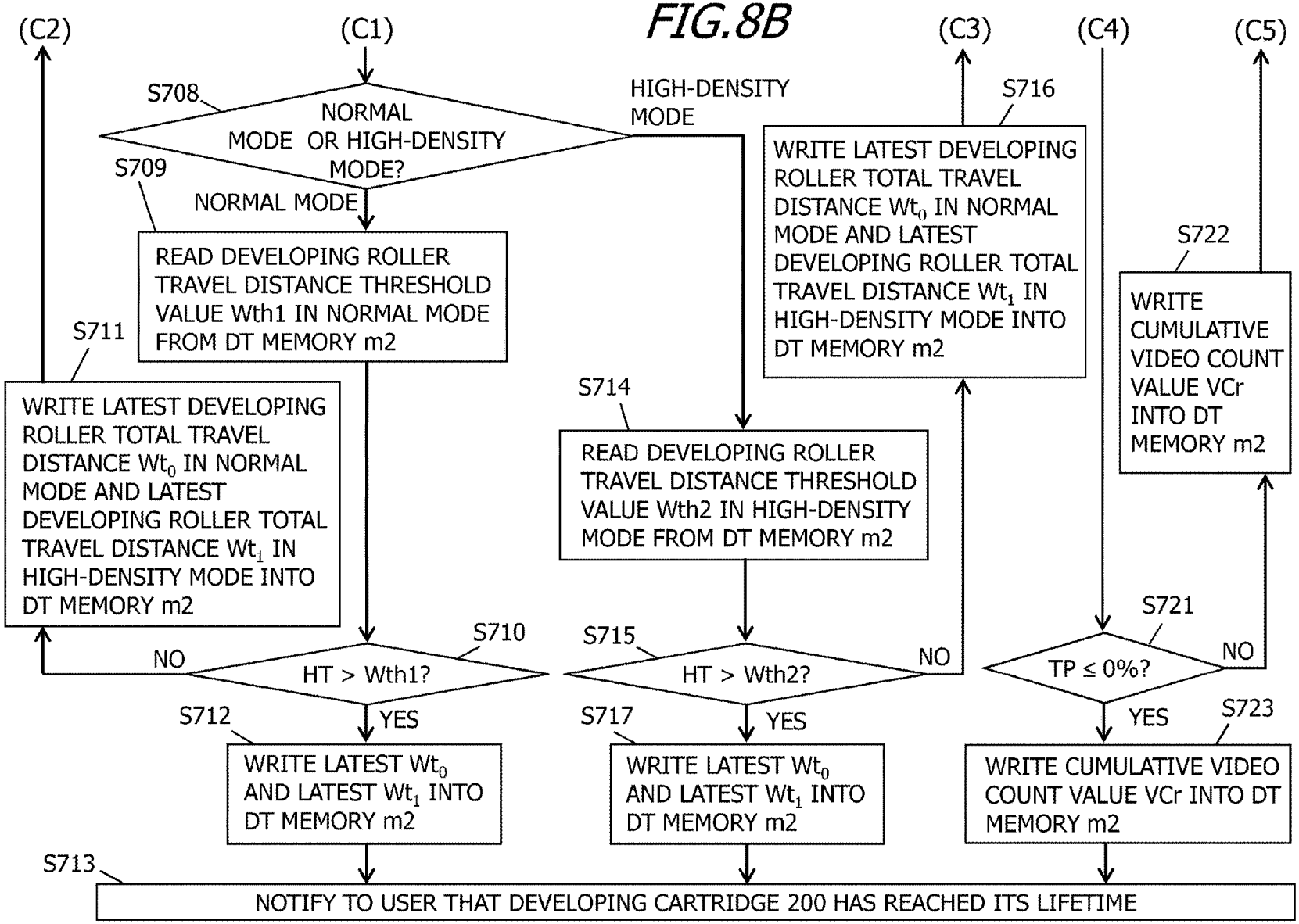

Next, the CPU 501 reads the developing roller travel distance correction coefficient k in accordance with the image formation mode from the DT memory m2 (S705). In addition, the CPU 501 respectively calculates a post-correction developing roller travel distance $Hu_0$ in the normal mode and a post-correction developing roller travel distance $Hu_1$ in the high-density mode on the basis of the developing roller travel distance correction coefficients k read in S705 (S706). For example, when the developing roller travel distance correction coefficient k with respect to the normal mode is 1 and the developing roller travel distance correction coefficient k with respect to the high-density mode is 1.5, the CPU 501 calculates $Hu_0$ and $Hu_1$ such that $Hu_0=Wt_0\times1$ and $Hu_1=Wt_1\times1.5$. Subsequently, using the calculated $Hu_0$ and $Hu_1$, the CPU 501 calculates a total travel distance Ht according to an arithmetic expression of $Ht=Hu_0+Hu_1$ (S707). Since processes of S708 and S709 in FIG. 8B are similar to the processes of S507 and S508 described with reference to FIG. 6B, a detailed description thereof will be omitted. Subsequently, the CPU 501 determines whether or not the calculated total travel distance Ht exceeds the travel distance threshold value $Wth_1$ in the normal mode (S710). In S711 and S712, the CPU 501 writes the first total value $Wt_0$ and the second total value $Wt_1$ updated in S704 into the DT memory m2.

Since processes of S713 and S714 in FIG. 8B are similar to the processes of S512 and S513 described with reference to FIG. 6B, a detailed description thereof will be omitted. Next, the CPU 501 determines whether or not the calculated total travel distance Ht exceeds the travel distance threshold value $Wth_2$ in the high-density mode (S715). In S716 and S717, the CPU 501 writes the first total value $Wt_0$ and the second total value $Wt_1$ updated in S704 into the DT memory m2. Since the processes of other steps are as described with reference to FIGS. 6A and 6B, a detailed description will be omitted here.

Third Alternative Developing Cartridge Lifespan Determination Sequence

The flow charts described with reference to FIGS. 8A and 8B may be further changed and the lifetime of the developing cartridge 200 may be determined by subtracting the first total value $Wt_0$ and the second total value $Wt_1$ in the high-density mode from a developing roller travelable distance TD as an initial value. Hereinafter, the aspect will be described in detail with reference to the flow charts shown in FIGS. 9A and 9B.

Figure 9A:
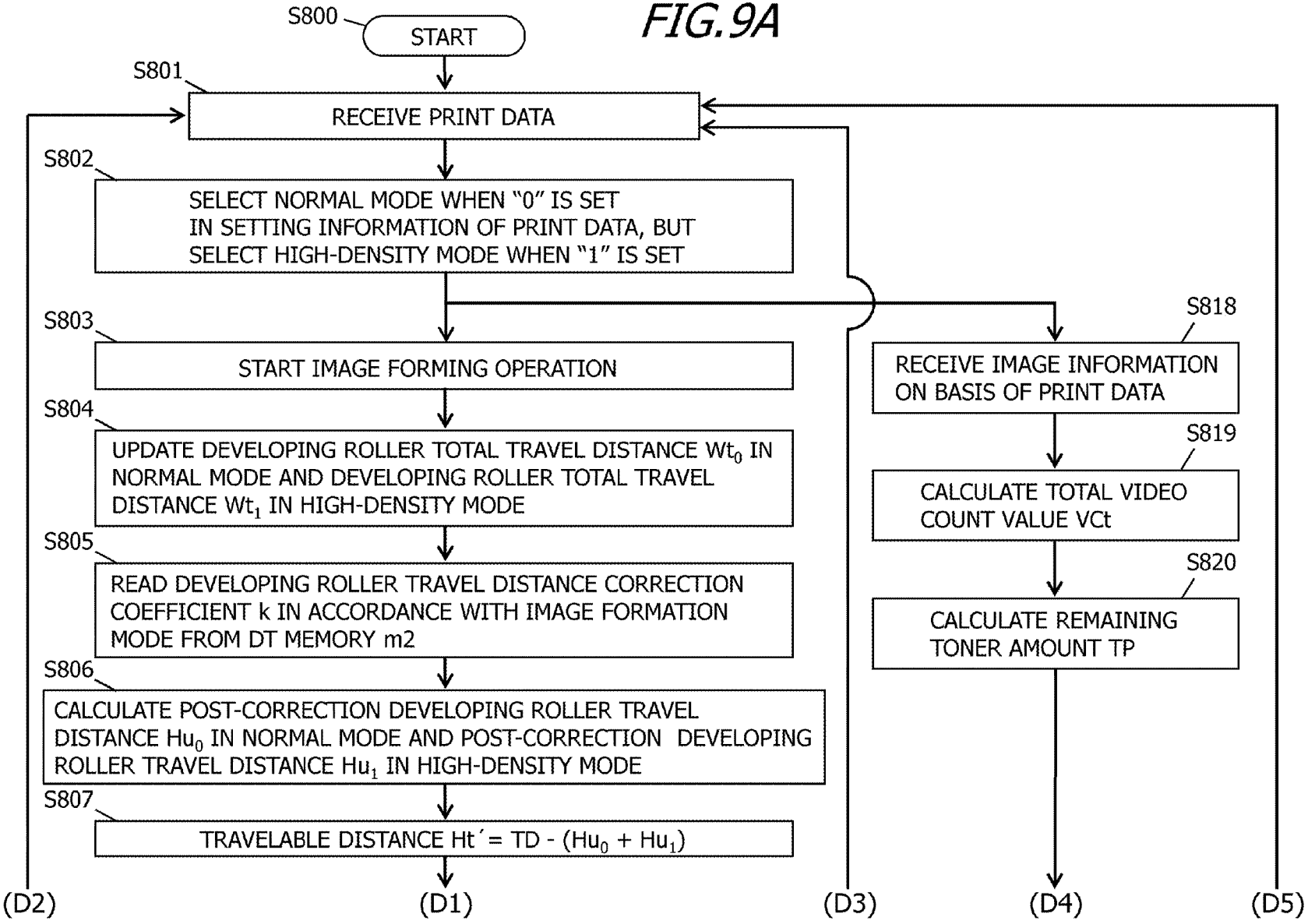
FIGS. 9A and 9B are sequence charts of another lifetime determination of a developing cartridge.

Since processes of S801 to S806 in FIG. 9A are similar to the processes of S701 to S706 described with reference to FIG. 8A, a detailed description thereof will be omitted. Next, the CPU 501 subtracts the first total value $Wt_0$ and the second total value $Wt_1$ from the developing roller travelable distance TD as an initial value and calculates a travelable distance Ht' (S807).

$$Ht'=TD-(Hu_0+Hu_1)$$

Figure 9B:
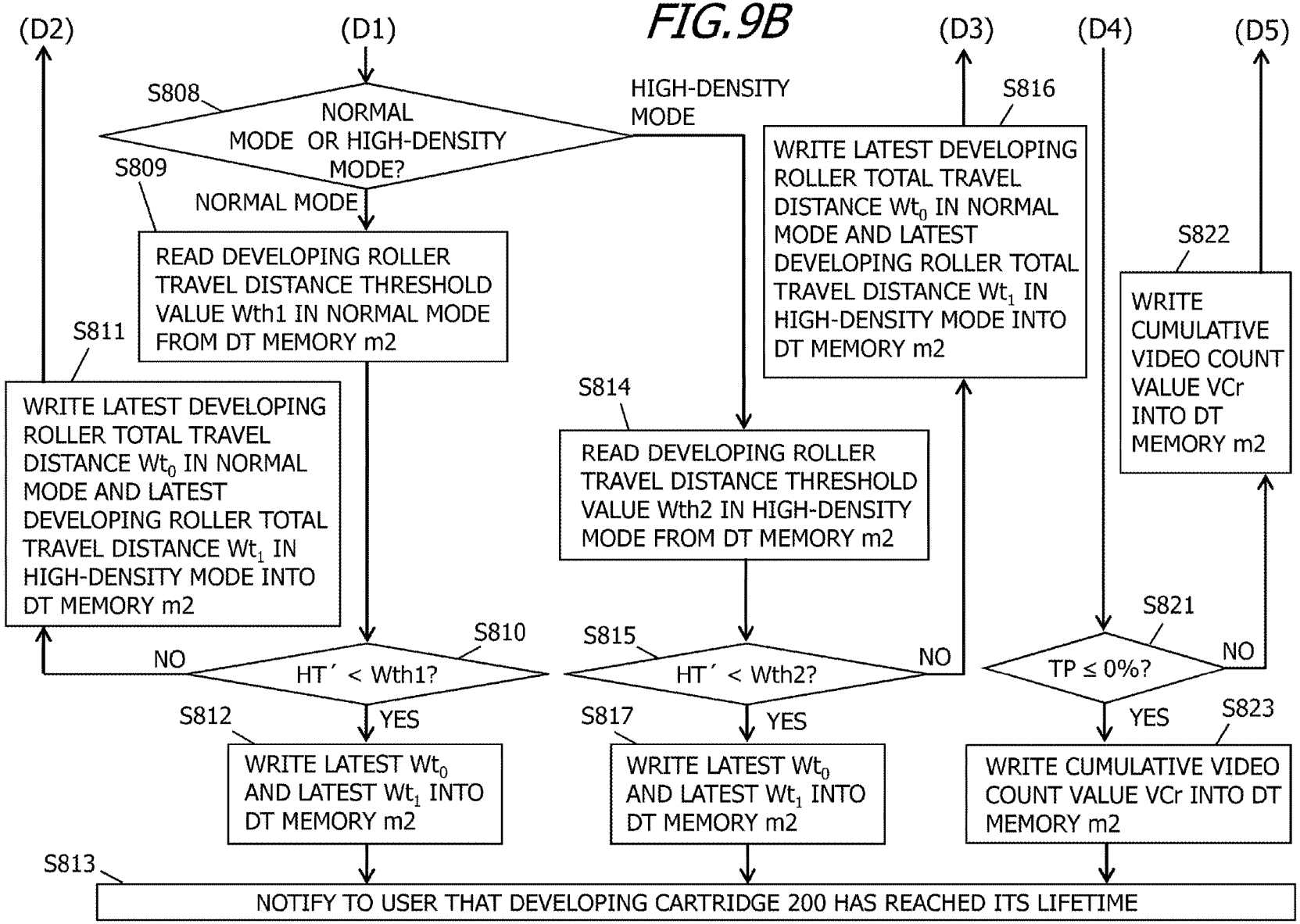

Since processes of S808 and S809 in FIG. 9B are similar to the processes of S507 and S508 described with reference to FIG. 6B, a detailed description thereof will be omitted.

Next, the CPU 501 determines whether or not the calculated travelable distance Ht' exceeds the travel distance threshold value $Wth_1$ in the normal mode (S810). In S811 and S812, the CPU 501 writes the first total value $Wt_0$ and the second total value $Wt_1$ updated in S804 into the DT memory m2.

Since processes of S813 and S814 in FIG. 9B are similar to the processes of S512 and S513 described with reference to FIG. 6B, a detailed description thereof will be omitted. Next, the CPU 501 determines whether or not the calculated travelable distance Ht' falls below the travel distance threshold value $Wth_2$ in the high-density mode (S815). In S816 and S817, the CPU 501 writes the first total value $Wt_0$ and the second total value $Wt_1$ updated in S804 into the DT memory m2. Since the processes of other steps are as described with reference to FIGS. 6A and 6B, a detailed description will be omitted here.

For example, in FIGS. 6A and 6B described above, the CPU 501 compares each of the travel distance threshold value Wth1 (the first lifetime threshold value) in the normal mode and the travel distance threshold value Wth2 (the second lifetime threshold value) in the high-density mode with the total developing roller travel distance HTn after correction. Subsequently, on the basis of the comparison result, the CPU 501 determines the lifetime of the developing cartridge 200 in each mode. In addition, for example, in the flow charts shown in FIGS. 8A and 8B, the CPU 501 compares each of the travel distance threshold value Wth1 (the first lifetime threshold value) in the normal mode and the travel distance threshold value Wth2 (the second lifetime threshold value) in the high-density mode with the total travel distance Ht. Subsequently, on the basis of the comparison result, the CPU 501 determines the lifetime of the developing cartridge 200 in each mode. In both flow charts, the travel distance threshold value (the lifetime threshold value) of each mode is used. However, this aspect is not restrictive.

For example, one lifetime threshold value Wth may be used, in which case the CPU 501 may read the lifetime threshold value from the DT memory m2 and respectively calculate and prepare a separate total travel distance for the normal mode and the high-density mode. Hereinafter, a case where the CPU 501 reads one travel distance threshold value Wth from the DT memory m2 will be described.

First, the CPU 501 acquires the total developing roller travel distance HTn (the first lifetime determination value) which is a calculation result of step S506. In addition, the CPU 501 adopts a total developing roller travel distance HTn' (the second lifetime determination value) obtained by multiplying the total developing roller travel distance HTn (the first lifetime determination value) by a correction coefficient D1 as a total developing roller travel distance at high density. For example, when Wth=3000000 [mm], HTn=2500000 [mm], and D1=1.25, the total developing roller travel distance HTn' at high density is HTn×D1=2500000 [mm]×1.25=3125000 [mm]. In other words, the CPU 501 determines that the developing cartridge 200 has reached its lifetime with respect to the high-density mode when Wth<3125000 [mm]. Even in the case of the flow charts shown in FIGS. 8A and 8B, a similar effect can be produced by multiplying Ht calculated by the CPU 501 in step S707 by D1.

In other words, the DT memory m2 stores the lifetime threshold value Wth (the travel distance threshold value Wth). In addition, the CPU 501 obtains the first lifetime determination value in the normal mode (the first mode) and the second lifetime determination value in the high-density mode (the second mode) from the developing roller travel distance HTn as a lifetime determination value obtained according to the progressive addition process in S506 shown in FIG. 6A. Alternatively, the developing roller travel distance HTn itself may be used as the first lifetime determination value. Subsequently, the CPU 501 compares the lifetime threshold value Wth stored in the DT memory m2 with the first lifetime determination value and determines whether or not the latest first lifetime determination value has exceeded the lifetime threshold value Wth. In addition, the CPU 501 compares the lifetime threshold value Wth stored in the DT memory m2 with the second lifetime determination value and determines whether or not the latest second lifetime determination value has exceeded the lifetime threshold value Wth. It should be noted that the various processes after the CPU 501 determines that each lifetime determination value exceeds the lifetime threshold value Wth are similar to those described above and a detailed description thereof will be omitted.

In addition, in the case of the flow charts shown in FIGS. 7A and 7B, the CPU 501 adopts the travelable distance HT'n calculated in step S606 for the normal mode and calculates a travelable distance at high density (HT'n)' on the basis of the travelable distance HT'n. More specifically, when a correction coefficient is denoted by E1, the CPU 501 may adopt a value obtained by subtracting E1 from the travelable distance HT'n as the travelable distance at high density (HT'n)'. Furthermore, in this case, one travel distance threshold value Wth (one lifetime threshold value Wth) is to be compared with the travelable distance.

For example, let us assume that E1 is 600000 [mm], the travel distance threshold value Wth (lifetime threshold value) is 0 [mm], and the travelable distance HT'n (the first travelable distance) calculated in step S606 is 500000 [mm]. In this case, the travelable distance in the high-density mode (HT'n)' (the second travelable distance) is (HT'n)'=500000 [mm]−600000 [mm]=−100000<0 (the lifetime threshold value Wth) and, therefore, the CPU 501 determines that the developing cartridge 200 has reached its lifetime with respect to the high-density mode. Meanwhile, since the travelable distance HT'n is 500000 [mm]>0 (the lifetime threshold value Wth), the CPU 501 does not determine that the developing cartridge 200 has reached its lifetime with respect to the normal mode. It should be noted that the various processes after the CPU 501 determines that each lifetime determination value exceeds the lifetime threshold value are similar to those described above and a detailed description thereof will be omitted.

Furthermore, even in the case of the flow charts shown in FIGS. 9A and 9B, a similar effect can be produced by subtracting E1 from the travelable distance Ht' calculated by the CPU 501 in step S807.

In other words, the DT memory m2 stores the lifetime threshold value Wth (the travel distance threshold value Wth). In addition, the CPU 501 calculates the first travelable distance (the first lifetime determination value) corresponding to the normal mode or the second travelable distance (the second lifetime determination value) corresponding to the high-density mode on the basis of the travelable distance Ht'n or the travelable distance Ht' obtained in S606 in FIG. 7A or in S807 in FIG. 9A. The CPU 501 obtains the second travelable distance (the second lifetime determination value) by, for example, subtracting E1 from the first travelable distance (the first lifetime determination value). Alternatively, the first travelable distance (the first lifetime determination value) may be the travelable distance Ht'n or the travelable distance Ht' itself obtained in S606 in FIG. 7A or in S807 in FIG. 9A.

In addition, the CPU 501 compares each travelable distance with the one travel distance threshold value Wth (the lifetime threshold value Wth) stored in the DT memory m2, and determines whether or not each travelable distance (each lifetime determination value) has fallen below the travel distance threshold value Wth. For example, the travel distance threshold value Wth may be set such that Wth=0. It should be noted that the various processes after the CPU 501 determines that each lifetime determination value (each travelable distance) falls below the lifetime threshold value Wth are similar to those described above and a detailed description thereof will be omitted.

SPECIFIC EXAMPLE

In the present embodiment, the developing roller travel distance correction coefficient k is changed in accordance with the remaining toner amount TP. In other words, as shown in Table 4, the developing roller travel distance correction coefficient k is divided into a plurality of correction coefficients (k1 to k3) in accordance with a range of the remaining toner amount TP. In addition, the CPU 501 is also capable of using correction coefficients divided in accordance with the remaining toner amount TP as the developing roller travel distance correction coefficient k. The plurality of correction coefficients are, for example, stored in the DT memory m2 and read by the CPU 501 when appropriate. Furthermore, the correction coefficients divided in accordance with the remaining toner amount TP in Table 4 may only be applied to the normal mode or the high-density mode or may be applied to both modes. While the remaining toner amount TP is divided into three in Table 4, the number of divisions is not limited thereto. For example, the remaining toner amount TP may be more finely divided into five. In addition, correction coefficients may be continuously calculated and used in accordance with a magnitude of a value of the remaining toner amount TP. A similar division can be applied when the remaining toner amount TP is replaced with a cumulative toner use amount.

TABLE 4

| Remaining toner amount TP | Developing roller travel distance correction coefficient k |
|---|---|
| 100% to 41% | k1 = 1.0 |
| 40% to 21% | k2 = 1.3 |
| 20% to 0% | k3 = 5.0 |

In addition, in Table 4, while a case where the developing roller travel distance correction coefficient k is changed in accordance with the remaining toner amount TP has been described, this is not restrictive. The developing roller travel distance correction coefficient k may be changed in accordance with the cumulative rotating number of the developing roller 4, the cumulative rotating time of the developing roller 4 or the use amount of toner, or a combination thereof may be used. The developing roller travel distance correction coefficient k need only be properly determined in accordance with a change in a parameter that contributes to the degradation of the developing roller 4 used.

Figure 10A:
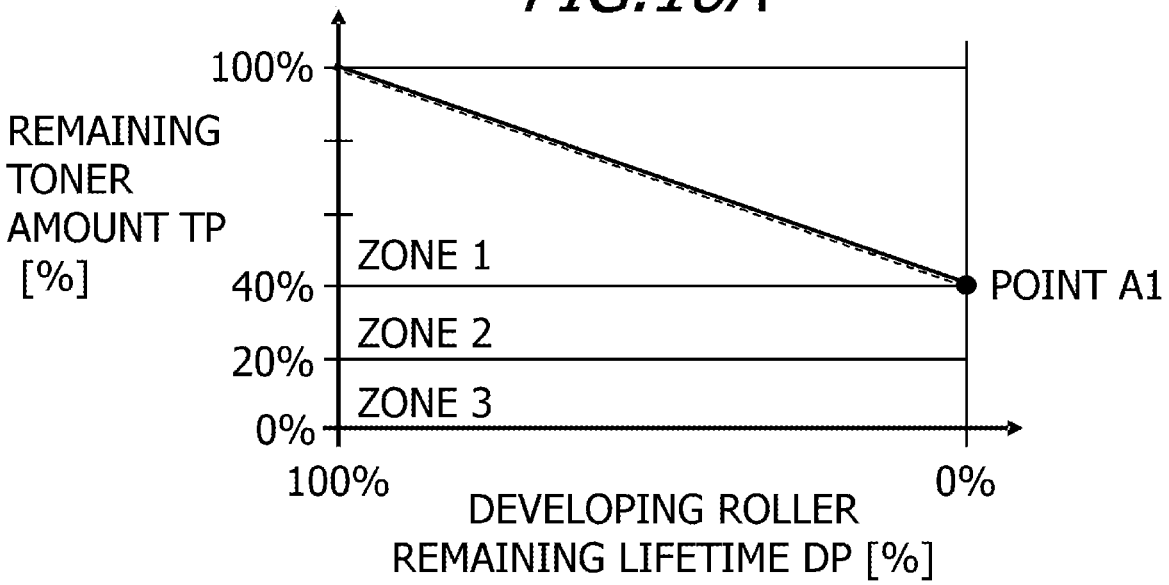
FIGS. 10A to 10C are relationship diagrams between a remaining toner amount and a remaining lifetime of a developing roller.
Figure 10B:
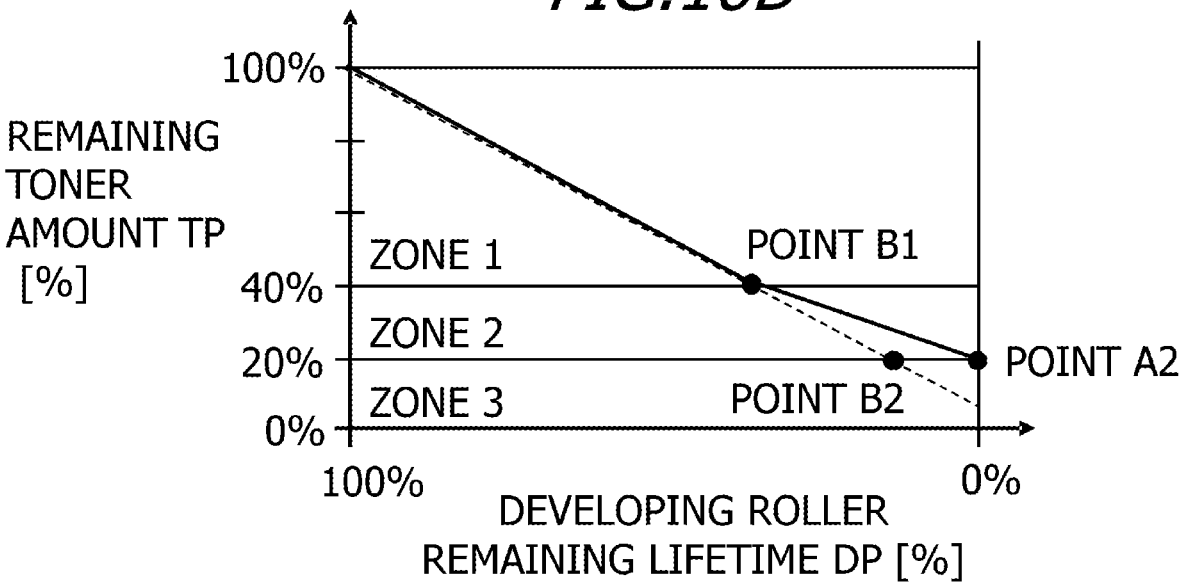
Figure 10C:
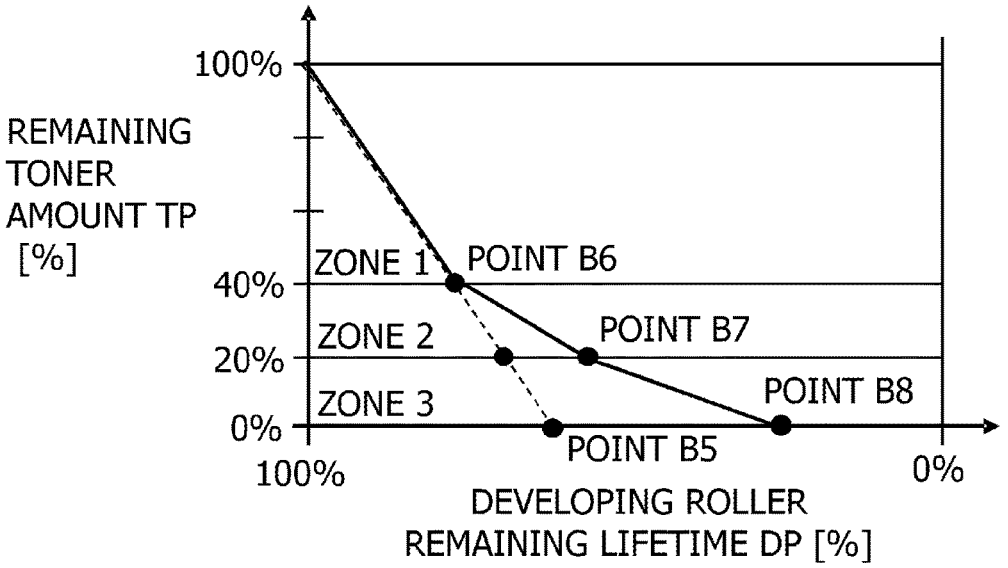

FIGS. 10A, 10B, and 10C are diagrams showing a relationship between the remaining toner amount TP and a remaining lifetime of the developing roller 4 when printing is performed using the image forming apparatus 100 while varying a print area (a print percentage: consumption of the toner 9 per sheet) to be printed on one sheet of the recording material 12. In each diagram, an ordinate represents the remaining toner amount TP [%] and an abscissa represents the developing roller remaining lifetime DP [%]. In each diagram, Zone 1 represents a region to which the developing roller travel distance correction coefficient k1 is applied, Zone 2 represents a region to which the developing roller travel distance correction coefficient k2 is applied, and Zone 3 represents a region to which the developing roller travel distance correction coefficient k3 is applied. When calculating the post-correction developing roller travel distance Hu, which developing roller travel distance correction coefficient k is to be used is determined on the basis of which Zone the remaining toner amount TP belongs to. In addition, in each diagram, a solid line indicates a trend in the developing roller remaining lifetime DP when correction of the travel distance of the developing roller 4 is performed and a dash line indicates a trend in the developing roller remaining lifetime DP when correction of the developing roller travel distance is not performed.

FIG. 10A shows a case where printing is performed at a constant print percentage of approximately 1%. In the case of FIG. 10A, since the solid line and the dash line are always present in Zone 1, the developing roller travel distance correction coefficient k1=1.0 is applied. Therefore, the developing roller remaining lifetime DP indicated by the solid line and the uncorrected developing roller remaining lifetime DP indicated by a dash line overlap with each other. In addition, at a time point (point A1) where the developing roller remaining lifetime DP reaches 0%, a notification of the lifetime of the developing cartridge 200 is performed.

FIG. 10B shows a case where printing is performed at a constant print percentage of approximately 1 to 2%. In the case of FIG. 10B, since the solid line and the dash line are present in Zone 1 until the remaining toner amount TP reaches 40%, the developing roller travel distance correction coefficient k1=1.0 is applied. When the remaining toner amount TP is within a range of 40% to 21%, since the solid line and the dash line are present in Zone 2, the developing roller travel distance correction coefficient k2=1.3 is applied. A gradient of the solid line changes from a point B1 (remaining toner amount TP=40%). In other words, when a correction of the travel distance W of the developing roller 4 is performed, a rate of increase of the travel distance of the developing roller 4 rises when the remaining toner amount TP is within the range of 40% to 21%. In addition, when a correction of the travel distance of the developing roller 4 is performed, at a time point (point A2) where the remaining toner amount TP reaches 20%, the developing roller remaining lifetime DP reaches 0% and a notification of the lifetime of the developing cartridge 200 is performed. Meanwhile, a gradient of the dash line has not changed. In other words, when a correction of the travel distance W of the developing roller 4 is not performed, a rate of increase of the travel distance of the developing roller 4 is constant regardless of the remaining toner amount TP.

FIG. 10C shows a case where printing is performed at a constant print percentage of approximately 7 to 8%. In the case of FIG. 10C, since the solid line and the dash line are present in Zone 1 until the remaining toner amount TP reaches 41%, the developing roller travel distance correction coefficient k1=1.0 is applied. When the remaining toner amount TP falls below 41%, since the solid line and the dash line are present in Zone 2, the developing roller travel distance correction coefficient k2=1.3 is applied. When the remaining toner amount TP falls below 21%, since the solid line and the dash line are present in Zone 3, the developing roller travel distance correction coefficient k3=5.0 is applied. A gradient of the solid line changes from a point B6 (remaining toner amount TP=40%) and a point B7 (remaining toner amount TP=20%). In other words, when a correction of the travel distance of the developing roller 4 is performed, the rate of increase of the travel distance of the developing roller 4 rises when the remaining toner amount TP is within the range of 40% to 21% and the rate of increase of the travel distance of the developing roller 4 further rises when the remaining toner amount TP is within the range of 20% to 0%. In addition, when a correction of the travel distance of the developing roller 4 is performed, at a time point (point B8) where the remaining toner amount TP reaches 0%, a notification of the lifetime of the developing cartridge 200 is performed.

Figure 11:
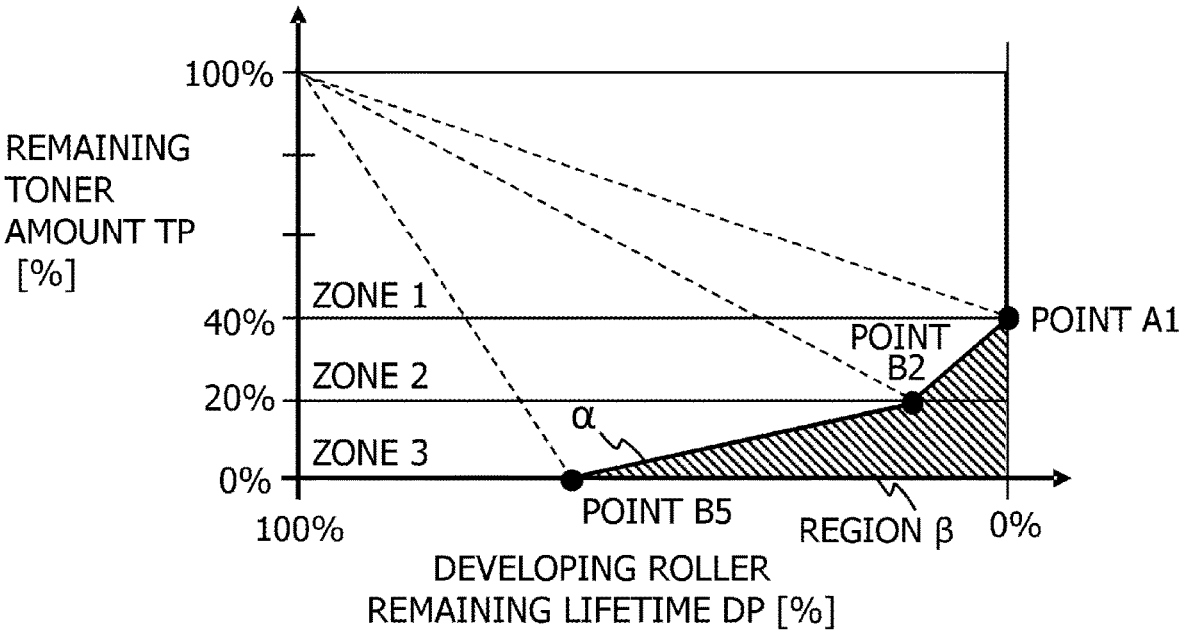
FIG. 11 is an explanatory diagram of a developing roller lifetime line.

A specific example of the respective cases shown in FIGS. 10A, 10B, and 10C will now be organized. A developing roller lifetime line a connecting point A1 in FIG. 10A, point B2 in FIG. 10B, and point B5 in FIG. 10C is shown in FIG. 11. The developing roller lifetime line a is a line indicating the lifetime of the developing cartridge 200 in a case where correction of the travel distance of the developing roller 4 is not performed. As shown in FIG. 11, the developing roller lifetime line α has been drawn where a remaining lifetime of the developing roller 4 is short (the travel distance of the developing roller 4 is long) and the remaining toner amount TP is small or, in other words, before the remaining lifetime of the developing roller 4 reaches 0%. This is because when the travel distance of the developing roller 4 is long and the remaining amount of the toner 9 is small, adhesion of the toner 9 to the developing roller 4 increases and control failure occurs in a region β shown in FIG. 11. Therefore, by performing a correction of the travel distance of the developing roller 4, the lifetime of the developing cartridge 200 can be set before the region β is reached.

For example, the travel distance threshold value $Wth_1$ in the normal mode and the travel distance threshold value $Wth_2$ in the high-density mode may be set to the values shown in Table 5.

TABLE 5

| Image formation mode | Travel distance threshold value |
|---|---|
| Normal mode | $Wth_1$ = 3000000 [mm] |
| High-density mode | $Wth_2$ = 2400000 [mm] |

The travel distance threshold value $Wth_2$ in the high-density mode is set lower than the travel distance threshold value $Wth_1$ in the normal mode because, as described earlier, image density non-uniformity due to banding is more likely to occur in the high-density mode.

Figure 12:
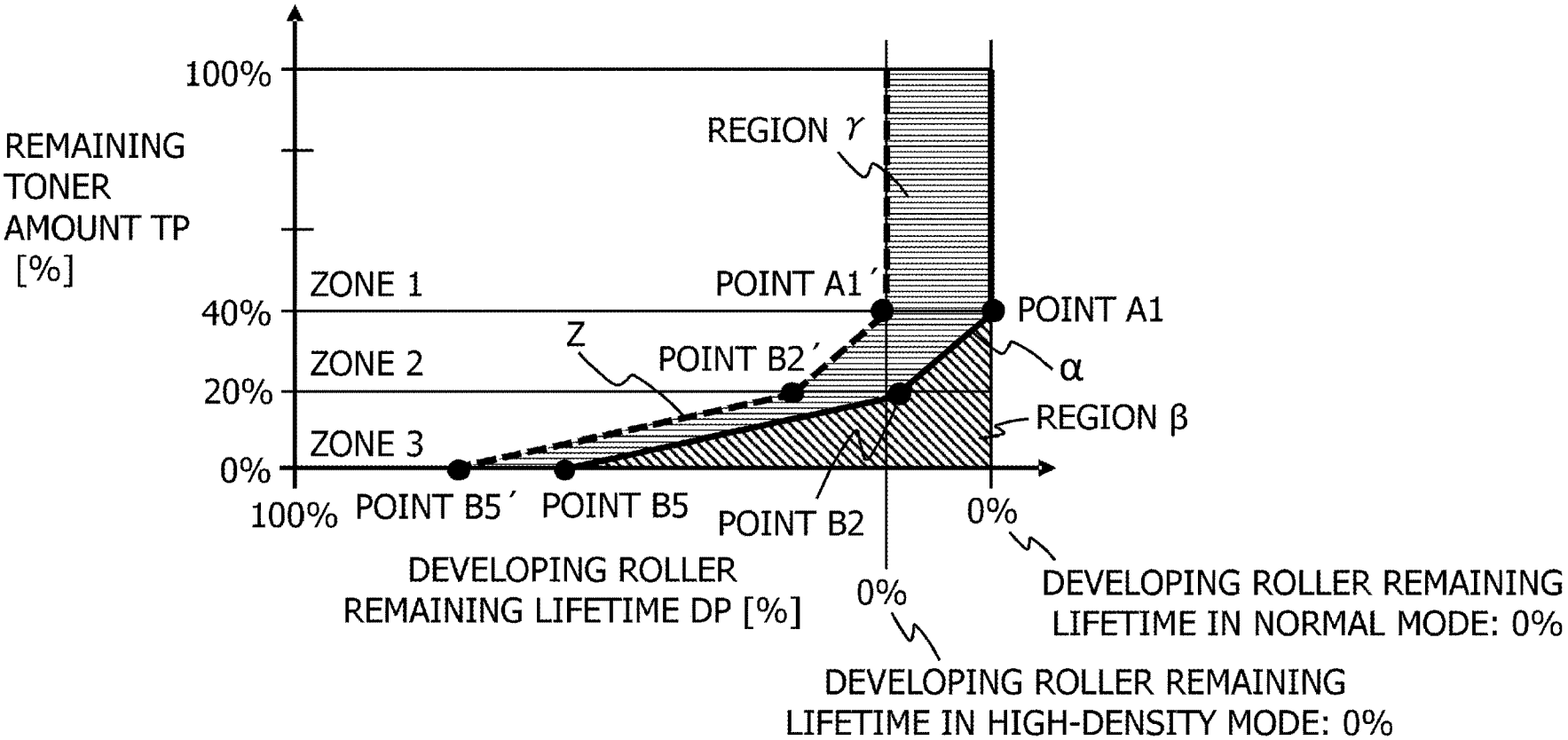
FIG. 12 is a diagram showing a notification timing of a lifetime of a developing cartridge.

FIG. 12 shows timings at which a lifetime of the developing cartridge 200 is announced in the normal mode and the high-density mode. The developing roller lifetime line α indicated by the solid line in FIG. 12 represents a lifetime line in the normal mode, and control failure occurs in the region β. A developing roller lifetime line Z (dash line) indicated by the dash line in FIG. 12 represents a lifetime line in the high-density mode, and control failure due to banding occurs in a region γ and the region β. In other words, the developing cartridge 200 can be used up to the developing roller lifetime line a (the solid line) in the normal mode, and the developing cartridge 200 can be used up to the developing roller lifetime line Z (the dash line) in the high-density mode. In addition, a notification of the lifetime of the developing cartridge 200 is performed at optimal timings in accordance with the image formation modes.

As described above, by respectively setting a travel distance threshold value in accordance with the image formation mode, a lifetime notification matching a timing of an image defect that occurs can be performed for each mode and the lifetime of the developing cartridge 200 can be announced without causing an adverse image effect in each mode.

While a cartridge configuration divided into the developing cartridge 200 and the drum cartridge 210 has been described, the cartridge configuration is not limited to the present embodiment and may include an AIO cartridge in which the developing cartridge 200 and the drum cartridge 210 are integrated with each other.

While a function for storing lifetime-related information is described as being provided in a nonvolatile memory of a cartridge, the storage function is not limited to the present embodiment and information may be stored in the image forming apparatus 100 and the like. While the normal mode and the high-density mode are described as two image formation modes, image formation modes are not limited to the present embodiment and the image forming apparatus 100 may further have a plurality of modes.

Modification of Usage of Developing Roller Travel Distance Correction Coefficient k While the developing roller travel distance correction coefficient k in the normal mode is described to be 1 and the developing roller travel distance correction coefficient k in the high-density mode is described to be 1.5 in the description of FIGS. 6A to 9B, these values are not restrictive. As long as a relationship between ratios of the developing roller travel distance correction coefficients of the respective modes and the travel distance threshold value Wth1 in the normal mode and the travel distance threshold value $Wth_2$ in the high-density mode is maintained, other correction coefficients may be assigned to the respective modes. Hereinafter, examples are shown in Tables 6 and 7.

TABLE 6

| | | | |
|---|---|---|---|
| Developing roller travel distance correction coefficient in normal mode | 1.0 | 2.0 | 0.5 |
| Developing roller travel distance correction coefficient in high-density mode | 1.5 | 3.0 | 0.75 |
| Travel distance threshold value in normal mode | $Wth_1$ | $2Wth_1$ | $0.5Wth_1$ |
| Travel distance threshold value in high-density mode | $Wth_2$ | $2Wth_2$ | $0.5Wth_2$ |

In addition, a similar description applies to the relationship between the developing roller travel distance correction coefficients in the respective modes and the developing roller travelable distance TD.

TABLE 7

| | | | |
|---|---|---|---|
| Developing roller travel distance correction coefficient in normal mode | 1.0 | 2.0 | 0.5 |
| Developing roller travel distance correction coefficient in high-density mode | 1.5 | 3.0 | 0.75 |
| Developing roller travelable distance TD | TD | 2TD | 0.5TD |

In this manner, while various aspects of a combination of a developing roller travel distance correction coefficient and the travel distance threshold value Wth may be envisaged with respect to each mode, a similar effect can be produced by any aspect. Specifically, a lifetime determination value can be updated by making, with respect to a same drive amount of the developing roller 4, a magnitude of drive amount information to be progressively added or progressively subtracted in the normal mode greater than a magnitude of drive amount information to be progressively added or progressively subtracted in the high-density mode.

In addition, while reading of a correction coefficient by the CPU 501 may be skipped when the developing roller travel distance correction coefficient k is 1 as described earlier, when a correction coefficient other than 1 is assigned, the CPU 501 must read a correction coefficient. Specifically, depending on what kind of a correction coefficient is assigned to each mode, the CPU 501 uses a correction coefficient only on the travel distance Wu measured in the normal mode or the high-density mode or uses correction coefficients on both travel distances Wu measured in the respective modes. Furthermore, in the cases of FIGS. 8A, 8B, 9A and 9B, a correction coefficient is only used on the first total value $Wt_0$ or the second total value $Wt_1$ or a correction coefficient is used with respect to both the first total value $Wt_0$ and the second total value $Wt_1$ having been progressively added in each of the respective modes. In this manner, in the present embodiment, an appropriate lifetime determination of the developing cartridge 200 can be performed by varying the way correction coefficients are used.

In the present embodiment, the developing roller travel distance correction coefficient k may be changed in accordance with the developing roller remaining lifetime DP. In other words, first, as shown in Table 8, the developing roller travel distance correction coefficient k is divided into a plurality of correction coefficients (k1 to k3) in accordance with a range of the developing roller remaining lifetime DP. In addition, the CPU 501 is also capable of using correction coefficients divided in accordance with the developing roller remaining lifetime DP as the developing roller travel distance correction coefficient k. The plurality of correction coefficients are, for example, stored in the DT memory m2 and read by the CPU 501 as appropriate. While the developing roller remaining lifetime DP is divided into three in Table 8, the number of divisions is not limited thereto. For example, the developing roller remaining lifetime DP may be more finely divided into five. In addition, correction coefficients may be continuously calculated and used in accordance with a magnitude of a value of the developing roller remaining lifetime DP. A similar division can be applied when the developing roller remaining lifetime DP is replaced with a developing roller cumulative drive amount.

TABLE 8

| Developing roller remaining lifetime DP | Developing roller travel distance correction coefficient k |
|---|---|
| 100% to 51% | k1 = 1.5 |
| 50% to 21% | k2 = 1.7 |
| 20% to 0% | k3 = 2.0 |

In addition, the correction coefficients divided in accordance with the developing roller remaining lifetime DP in Table 8 may only be applied to the normal mode or the high-density mode or may be applied to both modes. Furthermore, in Table 8, while a case where the developing roller travel distance correction coefficient k is changed in accordance with the developing roller remaining lifetime DP has been described, this is not restrictive. Information related to the developing roller remaining lifetime DP and information related to the use amount of the developing cartridge 200 may be used in combination. The developing roller travel distance correction coefficient k need only be properly determined in accordance with a change in a parameter that contributes to the degradation of the developing roller 4 used.

Second Embodiment

In the present embodiment, a correction coefficient is also stored in the O memory m1 mounted to the drum cartridge 210, and a correction coefficient is determined by combining the correction coefficient stored in the O memory m1 with a correction coefficient stored in the DT memory m2 mounted to the developing cartridge 200. As shown in FIG. 13, depending on a combination of a remaining lifetime of the drum cartridge 210 and a remaining lifetime of the developing cartridge 200, an occurrence status of image density non-uniformity due to banding in the high-density mode differs. This is because, when the remaining lifetime of the drum cartridge 210 becomes short, surface roughness of the photosensitive drum 1 increases and a coefficient of friction that is generated between the developing roller 4 and the photosensitive drum 1 decreases. Specifically, slippage of the developing roller 4 is suppressed and an occurrence of velocity non-uniformity with respect to the photosensitive drum 1 is suppressed. In other words, the lifetime of the developing cartridge 200 in the high-density mode changes in accordance with the lifetime of the drum cartridge 210. In consideration thereof, a correction coefficient (the fourth correction coefficient) divided in plurality in accordance with the remaining lifetime of the drum cartridge such as that shown in Table 9 is stored in the O memory m1 mounted to the drum cartridge 210. In addition, a notification of a more accurate lifetime can be made to the user by combining the fourth correction coefficient with the developing roller travel distance correction coefficient described earlier to determine a final developing roller travel distance correction coefficient k. While the drum cartridge remaining lifetime is divided into three in Table 9, the number of divisions is not limited thereto. For example, the drum cartridge remaining lifetime may be more finely divided into five. In addition, correction coefficients may be continuously calculated and used in accordance with a magnitude of a value of the drum cartridge remaining lifetime. A similar division can be applied when the drum cartridge remaining lifetime is replaced with a cumulative drum cartridge drive amount.

Furthermore, while the correction coefficient is stored in the O memory m1 mounted to the drum cartridge 210 in the present embodiment, the storage method is not limited thereto as long as a relationship between the remaining lifetime of the drum cartridge 210 and the correction coefficient can be correctly determined. For example, information indicating a relationship between usage of the drum cartridge 210 and the correction coefficient may be stored on the side of the image forming apparatus main body and the CPU 501 may be configured to be capable of recognizing the usage of the drum cartridge 210 from the O memory m1.

TABLE 9

| Drum cartridge remaining lifetime | Developing roller travel distance correction coefficient o |
|---|---|
| 100% to 60% | o1 = 1.0 |
| 59% to 30% | o2 = 1.1 |
| 29% to 0% | o3 = 1.2 |

Developing Roller Lifespan Calculation Sequence According to Present Embodiment

A sequence for calculating a developing roller travel distance according to the present embodiment will be described. It should be noted that descriptions of portions that overlap with the first embodiment will be omitted. The drum cartridge remaining lifetime is obtained using a degree of wear of the photosensitive drum 1 calculated from the number of rotations of the photosensitive drum 1, a film thickness of the carrier transfer layer or a shaving rate of the carrier transfer layer of the photosensitive drum 1 in an initial state stored in the O memory m1, and the like. Using Table 4 and Table 9, the post-correction developing roller travel distance Hu is obtained by multiplying a prescribed travel distance Wu by the developing roller travel distance correction coefficient kn stored in the DT memory m2 and the developing roller travel distance correction coefficient on stored in the O memory m1. A similar description applies to the post-correction developing roller travel distances $Hu_0$ and $Hu_1$ described with reference to FIGS. 8A, 8B, 9A and 9B.

$$Hu=Wu\times kn\times on(n=1, 2, 3)$$

For example, the developing roller travel distance correction coefficient k when the remaining toner amount TP is 30% and the drum cartridge remaining lifetime is 20% is $k=k1\times o3=1.3\times 0.85=1.105$. In this manner, when obtaining the post-correction developing roller travel distance Hu, the developing roller travel distance correction coefficient kn (the developing roller travel distance correction coefficient k after correction) having been corrected by the developing roller travel distance correction coefficient on may be used.

According to the present embodiment, by respectively setting a developing roller travel distance correction coefficient in accordance with the drum cartridge remaining lifetime, a lifetime notification in accordance with a timing of occurrence of an image defect can be performed. Therefore, the lifetime of the developing cartridge 200 can be announced without causing an adverse image effect in each image formation mode.

Third Embodiment

In the present embodiment, a developing roller travel distance threshold value is stored in the O memory m1 mounted to the drum cartridge 210. A developing roller travel distance threshold value such as that shown in Table 10 is stored in the O memory m1 mounted to the drum cartridge 210, and the CPU 501 calculates the developing roller remaining lifetime DP in accordance with the stored developing roller travel distance threshold value. Accordingly, a more accurate lifetime notification can be made to the user. For example, travel distance threshold values $Wth_2$, $Wth_3$, and $Wth_4$ in the high-density mode having been divided in plurality in accordance with the remaining lifetime of the drum cartridge such as that shown in Table 10 are stored in the O memory m1 mounted to the drum cartridge 210. While the drum cartridge remaining lifetime is divided into three in Table 10, the number of divisions is not limited thereto. For example, the drum cartridge remaining lifetime may be more finely divided into five. In addition, threshold values may be continuously calculated and used in accordance with a value of the drum cartridge remaining lifetime. A similar division can be applied when the drum cartridge remaining lifetime is replaced with a cumulative drum cartridge drive amount.

Furthermore, while the developing roller travel distance threshold value is stored in the O memory m1 mounted to the drum cartridge 210 in the present embodiment, the storage method is not limited thereto as long as a relationship between the remaining lifetime of the drum cartridge 210 and the developing roller travel distance threshold value can be correctly determined. For example, information indicating a relationship between usage of the drum cartridge 210 and the developing roller travel distance threshold value may be stored on the side of the image forming apparatus main body and the CPU 501 may be configured to be capable of recognizing the usage of the drum cartridge 210 from the O memory m1.

TABLE 10

| Drum cartridge remaining lifetime | Developing roller travel distance threshold value | |
|---|---|---|
| | Normal mode | High-density mode |
| 100% to 60% | $Wth_1$ = 3000000 [mm] | $Wth_2$ = 2400000 [mm] |
| 59% to 30% | $Wth_1$ – 3000000 [mm] | $Wth_3$ – 2550000 [mm] |
| 29% to 0% | $Wth_1$ – 3000000 [mm] | $Wth_4$ – 2700000 [mm] |

Developing Roller Travel Distance Calculation Sequence According to Present Embodiment A sequence for calculating a travel distance of a developing roller according to the present embodiment will be described. It should be noted that descriptions of portions that overlap with the first and second embodiments will be omitted.

For example, using the drum cartridge remaining lifetime obtained according to the second embodiment and Table 10, the CPU 501 determines a travel distance threshold value $Wth_L$ (L=2, 3, 4) in the high-density mode. The CPU 501 calculates the developing roller remaining lifetime DP1 in the normal mode from the total post-correction developing roller travel distance $HT_n$ and the travel distance threshold value $Wth_1$ in the normal mode. In addition, the CPU 501 calculates the developing roller remaining lifetime DP2 in the high-density mode from the total post-correction developing roller travel distance $HT_n$ and the travel distance threshold value $Wth_L$ in the high-density mode.

$$DP1\ [\%]=(1-HT_n/Wth_1)\times 100$$

$$DP2\ [\%]=(1-HT_n/Wth_L)\times 100\ (L=2, 3, 4)$$

For example, when the drum cartridge remaining lifetime is 20%, the travel distance threshold value $Wth_1$ in the normal mode is 3000000 and the travel distance threshold value $Wth_L=Wth_4$ in the high-density mode is 2700000. In addition, the developing roller remaining lifetime DP1 in the normal mode and the developing roller remaining lifetime DP2 in the high-density mode are as follows.

$$DP1\ [\%]=(1-HT_n/3000000)\times 100$$

$$DP2\ [\%]=(1-HT_n/2700000)\times 100$$

A similar description applies to the developing roller remaining lifetime DP1' in the normal mode and the developing roller remaining lifetime DP2' in the high-density mode described with reference to FIGS. 8A and 8B. In other words, the CPU 501 calculates the developing roller remaining lifetime DP1' in the normal mode from the travelable distance $HT'_n$ and the travel distance threshold value $Wth_1$ in the normal mode. In addition, the CPU 501 calculates the developing roller remaining lifetime DP2' in the high-density mode from the travelable distance $HT'_n$ and the travel distance threshold value $Wth_L$ in the high-density mode.

$$DP1'\ [\%]=(HT'_n/Wth_1)\times 100$$

$$DP2'\ [\%]=(HT'_n/Wth_L)\times 100\ (L=2, 3, 4)$$

As described above, by respectively setting a developing roller travel distance threshold value in accordance with the drum cartridge remaining lifetime, a lifetime notification in accordance with a timing of occurrence of an image defect can be performed. Accordingly, the lifetime of the developing cartridge 200 can be announced without causing an adverse image effect in each image formation mode.

Fourth Embodiment

In the present embodiment, a developing roller lifetime threshold value correction coefficient pk (k=2, 3, 4) in the high-density mode is stored in the O memory m1 mounted to the drum cartridge 210.

A developing roller lifetime threshold value correction coefficient pk (the fifth correction coefficient) in the high-density mode in accordance with the remaining lifetime of the drum cartridge such as that shown in Table 11 is stored in the O memory m1 mounted to the drum cartridge 210, and the CPU 501 calculates the developing roller remaining lifetime DP in accordance with the developing roller lifetime threshold value correction coefficient pk. While the drum cartridge remaining lifetime is divided into three in Table 11, the number of divisions is not limited thereto. For example, the drum cartridge remaining lifetime may be more finely divided into five. In addition, threshold values may be continuously calculated and used in accordance with a value of the drum cartridge remaining lifetime. A similar division can be applied when the drum cartridge remaining lifetime is replaced with a cumulative drum cartridge drive amount.

TABLE 11

| Drum cartridge remaining lifetime | Developing roller lifetime threshold value correction coefficient in high-density mode |
|---|---|
| 100% to 60% | p2 = 0.8 |
| 59% to 30% | p3 – 0.85 |
| 29% to 0% | P4 – 0.9 |

As shown in Table 11, the shorter the remaining lifetime of the drum cartridge, the larger a numerical value assigned to the developing roller lifetime threshold value correction coefficient pk in the high-density mode. In the present embodiment, the developing roller lifetime threshold value correction coefficient pk in the high-density mode in accordance with the remaining lifetime of the drum cartridge is stored in the O memory m1 mounted to the drum cartridge 210. However, the storage method is not limited thereto as long as a relationship between the remaining lifetime of the drum cartridge 210 and the developing roller lifetime threshold value correction coefficient pk in the high-density mode can be correctly determined. For example, information indicating a relationship between usage of the drum cartridge 210 and the developing roller lifetime threshold value correction coefficient pk in the high-density mode may be stored on the side of the image forming apparatus main body and the CPU 501 may be configured to be capable of recognizing the usage of the drum cartridge 210 from the O memory m1.

Developing Roller Travel Distance Determination Sequence According to Present Embodiment A sequence for determining a travel distance of a developing roller according to the present embodiment will be described. It should be noted that descriptions of portions that overlap with the first to third embodiments will be omitted.

Using the remaining lifetime of the drum cartridge and Table 11, the CPU 501 determines the developing roller lifetime threshold value correction coefficient pk in the high-density mode. In addition, the CPU 501 determines a travel distance threshold value $Wth_k$ in the high-density mode using the following formula.

$$Wth_k = Wth_1 \times pk \ (k=2, 3, 4)$$

The CPU 501 calculates the developing roller remaining lifetime DP1 in the normal mode from the total post-correction developing roller travel distance $HT_n$ and the travel distance threshold value $Wth_1$ in the normal mode. In addition, the CPU 501 calculates the developing roller remaining lifetime DP2 in the high-density mode from the total post-correction developing roller travel distance $HT_n$ and the travel distance threshold value $Wth_k$ in the high-density mode.

$$DP1\ [\%] = (1 - HT_n/Wth_1) \times 100$$

$$DP2\ [\%] = (1 - HT_n/Wth_k) \times 100 \ (k=2, 3, 4)$$

For example, when the drum cartridge remaining lifetime is 20%, the travel distance threshold value $Wth_k$ in the high-density mode is 2700000 ($Wth_3$=3000000×0.9) and the developing roller remaining lifetimes DP1 and DP2 in the normal mode and the high-density mode are as follows.

$$DP1\ [\%] = (1 - HT_n/3000000) \times 100$$

$$DP2\ [\%] = (1 - HT_n/2700000) \times 100$$

A similar description applies to the developing roller remaining lifetime DP1' in the normal mode and the developing roller remaining lifetime DP2' in the high-density mode described with reference to FIGS. 8A and 8B, and a calculation method is similar to that of the third embodiment.

As described above, by setting a developing roller lifetime threshold value correction coefficient in the high-density mode in accordance with the drum cartridge lifetime, a lifetime notification in accordance with a timing of occurrence of an image defect can be performed. Therefore, the lifetime of the developing cartridge 200 can be announced without causing an adverse image effect in each image formation mode.

According to the description presented above, a lifetime of a developing apparatus can be appropriately determined even in an image forming apparatus having a plurality of image formation modes with different rotational peripheral velocity ratios between a photosensitive drum and a developing roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-001415, filed on Jan. 8, 2019, and Japanese Patent Application No. 2019-213343, filed on Nov. 26, 2019 which are hereby incorporated by reference herein in their entirety.

What is claimed is:

1. An image forming apparatus, comprising:

a rotatable image bearing member;

a developing apparatus including a developer bearing member which supplies a developer to the image bearing member and which develops an electrostatic latent image on the image bearing member, the image forming apparatus having a first mode in which the developer bearing member rotates at a first peripheral velocity ratio with respect to the image bearing member and a second mode in which the developer bearing member rotates at a second peripheral velocity ratio that is larger than the first peripheral velocity ratio with respect to the image bearing member;

a storage unit which stores a first lifetime threshold value of the developing apparatus corresponding to the first mode and a second lifetime threshold value of the developing apparatus corresponding to the second mode;

a controller which, on the basis of first drive amount information when the developer bearing member operates in the first mode and second drive amount information when the developer bearing member operates in the second mode, progressively adds drive amount information of the developer bearing member with respect to a lifetime determination value of the developing apparatus or progressively subtracts the drive amount information of the developer bearing member from an initial value to update the lifetime determination value; and a notifying unit, wherein the controller performs:

a first determination related to a lifetime in the first mode on the basis of (i) the first lifetime threshold value and the lifetime determination value or (ii) the lifetime determination value and a third lifetime threshold value calculated using one of the second lifetime threshold value and a reference lifetime threshold value; and a second determination related to a lifetime in the second mode on the basis of (i) the second lifetime threshold value and the lifetime determination value or (ii) the lifetime determination value and a fourth lifetime threshold value calculated using one of the first lifetime threshold value and the reference lifetime threshold value, wherein the notifying unit performs a notification on the basis of a determination result by the controller, and wherein, after the controller makes a notification on the basis of a determination result of the second determination, the controller allows continuous execution of the first mode.

2. The image forming apparatus according to claim 1, wherein the controller compares the lifetime determination value with the first lifetime threshold value and determines whether the lifetime determination value exceeds or falls below the first lifetime threshold value, and compares the lifetime determination value with the second lifetime threshold value and determines whether the lifetime determination value exceeds or falls below the second lifetime threshold value.

3. The image forming apparatus according to claim 2, further comprising a remaining amount acquisition portion which acquires an amount of a developer stored in a developer container to be supplied to the developer bearing member, wherein the controller determines that the developing apparatus has reached a lifetime of the developing apparatus when a remaining amount of the developer is small even when the lifetime determination value does not exceed the first lifetime threshold value or the second lifetime threshold value.

4. The image forming apparatus according to claim 1, wherein the second lifetime threshold value is divided by a plurality of ranges in accordance with a remaining lifetime of the developer bearing member, and the controller performs the second determination related to the lifetime in the second mode on the basis of the second lifetime threshold value having been divided by the plurality of ranges and the lifetime determination value.

5. An image forming apparatus, comprising:

a rotatable image bearing member;

a developing apparatus including a developer bearing member which supplies a developer to the image bearing member and which develops an electrostatic latent image on the image bearing member, the image forming apparatus having a first mode in which the developer bearing member rotates at a first peripheral velocity ratio with respect to the image bearing member and a second mode in which the developer bearing member rotates at a second peripheral velocity ratio that is larger than the first peripheral velocity ratio with respect to the image bearing member;

a storage unit which stores one or more of a first lifetime threshold value of the developing apparatus corresponding to the first mode, a second lifetime threshold value of the developing apparatus corresponding to the second mode, and a reference lifetime threshold value;

a controller which calculates a lifetime determination value on the basis of first drive amount information when the developer bearing member operates in the first mode and second drive amount information when the developer bearing member operates in the second mode; and a notifying unit, wherein the controller performs:

a first determination related to a lifetime in the first mode on the basis of (i) the first lifetime threshold value and the lifetime determination value or (ii) the lifetime determination value and a third lifetime threshold value calculated using one of the second lifetime threshold value and the reference lifetime threshold value; and a second determination related to a lifetime in the second mode on the basis of (i) the second lifetime threshold value and the lifetime determination value or (ii) the lifetime determination value and a fourth lifetime threshold value calculated using one of the first lifetime threshold value and the reference lifetime threshold value, wherein the notifying unit performs a notification on the basis of a determination result by the controller, and wherein, after the controller makes a notification on the basis of a determination result of the second determination, the controller allows continuous execution of the first mode.

6. The image forming apparatus according to claim 5, wherein the controller compares the lifetime determination value with the first lifetime threshold value or the third lifetime threshold value and determines whether the lifetime determination value exceeds or falls below the first lifetime threshold value or the third lifetime threshold value, and compares the lifetime determination value with the second lifetime threshold value or the fourth lifetime threshold value and determines whether the lifetime determination value exceeds or falls below the second lifetime threshold value or the fourth lifetime threshold value.

7. The image forming apparatus according to claim 6, further comprising a remaining amount acquisition portion which acquires an amount of a developer stored in a developer container to be supplied to the developer bearing member, wherein the controller determines that the developing apparatus has reached a lifetime of the developing apparatus when a remaining amount of the developer is small even when the lifetime determination value does not exceed the first lifetime threshold value, the second lifetime threshold value, the third lifetime threshold value, or the fourth lifetime threshold value.

8. An image forming apparatus, comprising:

a rotatable image bearing member;

a developing apparatus including a developer bearing member which supplies a developer to the image bearing member and which develops an electrostatic latent image on the image bearing member, the image forming apparatus having a first mode in which the developer bearing member rotates at a first peripheral velocity ratio with respect to the image bearing member and a second mode in which the developer bearing member rotates at a second peripheral velocity ratio that is larger than the first peripheral velocity ratio with respect to the image bearing member;

a storage unit which stores a lifetime threshold value of the developing apparatus;

a controller which calculates a first lifetime determination value corresponding to the first mode and a second lifetime determination value corresponding to the second mode on the basis of first drive amount information when the developer bearing member operates in the first mode and second drive amount information when the developer bearing member operates in the second mode; and a notifying unit, wherein the controller causes the notifying unit to:

perform a first notification related to a lifetime of the developing apparatus in the first mode on the basis of a comparison between the lifetime threshold value and the first lifetime determination value; and perform a second notification related to the lifetime of the developing apparatus in the second mode on the basis of a comparison between the lifetime threshold value and the second lifetime determination value, and wherein, after the controller makes a notification on the basis of a determination result of the second determination, the controller allows continuous execution of the first mode.

9. An image forming apparatus, comprising:

a rotatable image bearing member;

a developing apparatus including a developer bearing member which supplies a developer to the image bearing member and which develops an electrostatic latent image on the image bearing member, the image forming apparatus having a first mode in which the developer bearing member rotates at a first peripheral velocity ratio with respect to the image bearing member and a second mode in which the developer bearing member rotates at a second peripheral velocity ratio that is larger than the first peripheral velocity ratio with respect to the image bearing member;

a storage unit which stores a first lifetime threshold value of the developing apparatus corresponding to the first mode, a second lifetime threshold value of the developing apparatus corresponding to the second mode, and a first correction coefficient;

a controller which, on the basis of first drive amount information when the developer bearing member operates in the first mode and second drive amount information when the developer bearing member operates in the second mode, progressively adds drive amount information of the developer bearing member with respect to a lifetime determination value of the developing apparatus or progressively subtracts the drive amount information of the developer bearing member from an initial value to update the lifetime determination value; and a notifying unit, wherein the controller performs:

using the stored first correction coefficient, updating of the lifetime determination value by making a magnitude of drive amount information to be progressively added or progressively subtracted based on the second drive amount information larger than a magnitude of drive amount information to be progressively added or progressively subtracted based on the first drive amount information with respect to a same drive amount of the developer bearing member;

a first determination related to a lifetime in the first mode on the basis of (i) the first lifetime threshold value and the lifetime determination value or (ii) the lifetime determination value and a third lifetime threshold value calculated using one of the second lifetime threshold value and a reference lifetime threshold value; and a second determination related to a lifetime in the second mode on the basis of (i) the second lifetime threshold value and the lifetime determination value or (ii) the lifetime determination value and a fourth lifetime threshold value calculated using one of the first lifetime threshold value and the reference lifetime threshold value, and wherein the notifying unit performs a notification on the basis of a determination result by the controller.

10. The image forming apparatus according to claim 9, wherein the first correction coefficient includes at least one of a second correction coefficient in accordance with information related to a use amount of the developing apparatus and a third correction coefficient in accordance with a rotational peripheral velocity ratio between the image bearing member and the developer bearing member.

11. The image forming apparatus according to claim 9, wherein the storage unit stores a fourth correction coefficient in accordance with a remaining lifetime of the developer bearing member, and the controller uses, with respect to the first drive amount information and/or the second drive amount information, the first correction coefficient having been corrected with the fourth correction coefficient.

12. The image forming apparatus according to claim 9, wherein the storage unit stores a fifth correction coefficient in accordance with a remaining lifetime of the developer bearing member, and the controller performs the second determination on the basis of the second lifetime threshold value having been corrected with the fifth correction coefficient and the lifetime determination value.

13. An image forming apparatus, comprising:

a rotatable image bearing member;

a developing apparatus including a developer bearing member which supplies a developer to the image bearing member and which develops an electrostatic latent image on the image bearing member, the image forming apparatus having a first mode in which the developer bearing member rotates at a first peripheral velocity ratio with respect to the image bearing member and a second mode in which the developer bearing member rotates at a second peripheral velocity ratio that is larger than the first peripheral velocity ratio with respect to the image bearing member;

a storage unit which stores one or more of a first lifetime threshold value of the developing apparatus corresponding to the first mode, a second lifetime threshold value of the developing apparatus corresponding to the second mode, a reference lifetime threshold value, and a first correction coefficient;

a controller which calculates a lifetime determination value on the basis of first drive amount information when the developer bearing member operates in the first mode and second drive amount information when the developer bearing member operates in the second mode; and a notifying unit, wherein the controller performs:

using the stored first correction coefficient, updating of the lifetime determination value by making a magnitude of drive amount information to be progressively added or progressively subtracted based on the second drive amount information larger than a magnitude of drive amount information to be progressively added or progressively subtracted based on the first drive amount information with respect to a same drive amount of the developer bearing member;

a first determination related to a lifetime in the first mode on the basis of (i) the first lifetime threshold value and the lifetime determination value or (ii) the lifetime determination value and a third lifetime threshold value calculated using one of the second lifetime threshold value and the reference lifetime threshold value; and a second determination related to a lifetime in the second mode on the basis of (i) the second lifetime threshold value and the lifetime determination value or (ii) the lifetime determination value and a fourth lifetime threshold value calculated using one of the first lifetime threshold value and the reference lifetime threshold value, and wherein the notifying unit performs a notification on the basis of a determination result by the controller.

14. An image forming apparatus, comprising:

a rotatable image bearing member;

a developing apparatus including a developer bearing member which supplies a developer to the image bearing member and which develops an electrostatic latent image on the image bearing member, the image forming apparatus having a first mode in which the developer bearing member rotates at a first peripheral velocity ratio with respect to the image bearing member and a second mode in which the developer bearing member rotates at a second peripheral velocity ratio that is larger than the first peripheral velocity ratio with respect to the image bearing member;

a storage unit which stores a lifetime threshold value of the developing apparatus, and a first correction coefficient;

a controller which calculates a first lifetime determination value corresponding to the first mode and a second lifetime determination value corresponding to the second mode on the basis of first drive amount information when the developer bearing member operates in the first mode and second drive amount information when the developer bearing member operates in the second mode; and a notifying unit, wherein the controller causes:

using the stored first correction coefficient, updating of the lifetime determination value by making a magnitude of drive amount information to be progressively added or progressively subtracted based on the second drive amount information larger than a magnitude of drive amount information to be progressively added or progressively subtracted based on the first drive amount information with respect to a same drive amount of the developer bearing member;

the notifying unit to perform a first notification related to a lifetime of the developing apparatus in the first mode on the basis of a comparison between the lifetime threshold value and the first lifetime determination value; and the notifying unit to perform a second notification related to the lifetime of the developing apparatus in the second mode on the basis of a comparison between the lifetime threshold value and the second lifetime determination value.

* * * * *